US006395466B1

(12) United States Patent
Katoh et al.

(10) Patent No.: US 6,395,466 B1
(45) Date of Patent: May 28, 2002

(54) HEAT-DEVELOPABLE IMAGE RECORDING MATERIAL

(75) Inventors: Kazunobu Katoh; Minoru Sakai, both of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/547,761

(22) Filed: Apr. 12, 2000

(30) Foreign Application Priority Data

Apr. 12, 1999 (JP) ..... 11-104272

(51) Int. Cl.[7] ..... G03L 1/498
(52) U.S. Cl. ..... 430/619; 430/264; 430/617
(58) Field of Search ..... 430/619, 617, 430/203, 264

(56) References Cited

U.S. PATENT DOCUMENTS

| | | | | | |
|---|---|---|---|---|---|
| 5,496,695 | A | | 3/1996 | Simpson et al. | |
| 5,545,515 | A | | 8/1996 | Murray et al. | |
| 5,654,130 | A | | 8/1997 | Murray | |
| 5,705,324 | A | | 1/1998 | Murray | |
| 5,928,856 | A | * | 7/1999 | Weaver et al. | 430/617 |
| 6,037,115 | A | * | 3/2000 | Alton et al. | 430/619 |
| 6,146,823 | A | * | 11/2000 | Katoh | 430/619 |

* cited by examiner

*Primary Examiner*—Thorl Chea
(74) *Attorney, Agent, or Firm*—Birch, Stewart, Kolasch & Birch LLP

(57) ABSTRACT

A heat-developable image recording material containing an organic silver salt, a reducing agent and an organic binder characterized in that the reducing agent comprises a combination of two or more different kinds of reductive compounds exhibiting superadditivity was disclosed.

10 Claims, No Drawings

HEAT-DEVELOPABLE IMAGE RECORDING MATERIAL

FIELD OF THE INVENTION

The present invention relates to a so-called heat-developable image recording material capable of producing image through development by heating without an aid of developing solution.

BACKGROUND OF THE INVENTION

Heat-developable image recording materials capable of producing an image by heat development are described, for example, in U.S. Pat. Nos. 3,152,904 and 3,457,075 and "Imaging Processes and Materials", Neblette's 8th ed., page 279–291, (1969). The image recording materials disclosed in these literatures contain a reducible non-photosensitive silver source (e.g., organic silver salt), a catalytic amount of photocatalyst (e.g., silver halide), a color toner for controlling color tone of silver image, and a reducing agent for silver, all of which are usually dispersed in an organic binder matrix. While the heat-developable image recording materials are stable at room temperature, they produce blackened silver when heated, after light exposure, to a high temperature (e.g., 120° C.) through redox reaction between the reducible silver source and the reducing agent. This reaction is promoted by a catalystic action of latent image generated by the exposure.

In another mode of the embodiment without using a catalytic amount of silver halide, a blackened image is also obtainable by image-wise tracing using a thermal head at high temperatures.

Such image recording materials are increasingly attracting attention as those to be combined with, for example, a laser beam drawing apparatus, since an image forming process using such materials requires no processing liquid such as developing solution but only heating, and therefore generates neither sulfurous acid gas nor ammonia gas. The laser beam drawing apparatus is utilized in medical, printing plate making, industrial and many other fields.

In general, a temperature of 110° C. or above and a heating period of 10 to 60 seconds are required to develop these heat-developable image recording materials.

Keeping pace with advances in the laser beam drawing apparatus, the output speed has been increasing, which requires improvements in sensitivity and development speed of the recording material. In recent years, a material based on infectious development by an ultrahigh contrast agent is under investigation as a heat-developable image recording material for printing plate making. More faster speed of the development is, however, desired since the development period thereof tends to become longer due to the principle of infectious development. Raising the development temperature for increasing the development speed will generally result in increased fog, so that the development temperature is limitative. It is thus needed a heat-developable image recording material allowing a high development speed within a temperature range less causative of increased fog.

Gradation hardeners for producing high-contrast image ever known include acylhydrazine derivatives disclosed in U.S. Pat. No. 3,464,738, , No. 5,512,411, No. 5,496,695 and No. 5,536,622; acrylonitrile derivatives disclosed in U.S. Pat. Nos. 5,545,515 and 5,635,339; malondialdehydes disclosed in U.S. Pat. No. 5,654,130; and isoxazoles disclosed in U.S. Pat. No. 5,705,324. Known compounds for accelerating development include amine compounds disclosed in U.S. Pat. No. 5,545,505; hydroxamic acids disclosed in U.S. Pat. No. 5,545,507; and hydrogen atom donors disclosed in U.S. Pat. No. 5,637,449.

It is, however, still insufficient to meet a desired high level of the development speed.

Another problem relates to a large dependence on the heat development temperature and difficulty in obtaining an uniform image due to non-uniform temperature distribution in a heat developing apparatus. Although the temperature distribution is required to be kept within ±1° C., and preferably ±0.5° C., it is practice difficult to meet the requirement on the commercial basis.

In particular, use of an ultrahigh contrast agent for obtaining an ultrahigh contract image tends to increase the temperature dependence, so that a technique for reducing such dependence on the heat development temperature has been desired.

SUMMARY OF THE INVENTION

It is therefore as object of the present invention to provide an improved heat-developable image recording material, in particular a high contrast heat-developable image recording material, and more specifically a heat-developable image recording material allowing a rapid development process and yielding an uniform and stable image formation.

The above object was achieved by the present invention described below:

(1) A heat-developable image recording material containing an organic silver salt, a reducing agent and an organic binder characterized in that the reducing agent comprises a combination of two or more different kinds of reductive compounds exhibiting superadditivity;

(2) The heat-developable image recording material as described in the above (1) wherein either one of the superadditive reductive compound constituting the combination is a hindered phenol compound and the other is a substituted sulfonamidephenol compound;

(3) The heat-developable image recording material as described in the above (2) wherein the hindered phenol compound is contained within a range from $1\times10^{-2}$ to 10 mol per one mol of silver, and the sulfonamidophenol compound is a range from $1\times10^{-4}$ to $1\times10^{-1}$ mol per one mol of silver;

(4) The heat-developable image recording material as described in any one of the above (1) to (3), wherein a ratio of the substituted sulfonamidophenol compound to the hindered phenol compound is within a range from 0.1 to 50 mol %.

(5) The heat-developable image recording material as described in the above (4), wherein a ratio of the substituted sulfonamidophenol compound to the hindered phenol compound is within a range from 0.5 to 20 mol %.

(6) The heat-developable image recording material as described in any one of the above (1) to (5), wherein the substituted sulfonamidophenol compound is represented by the following formula (1):

Formula (1)

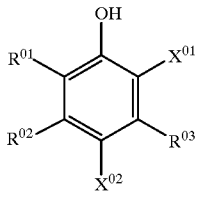

in the above formula, $X^{01}$ and $X^{02}$ independently represent a hydrogen atom; halogen atom, or substituent which is bound to the benzene ring via a carbon atom, oxygen atom, nitrogen atom, or sulfur atom; at least either of which being a sulfonamido group; $R^{01}$, $R^{02}$ and $R^{03}$ independently represent a hydrogen atom; halogen atom, or substituent which is bound to the benzene ring via a carbon atom, oxygen atom, nitrogen atom, or sulfur atom; these substiuents may be taken together with the adjacent ones or with a benzene ring to form a cyclic structure; and at least one of $X^{01}$, $X^{02}$, $R^{01}$, $R^{02}$ and $R^{03}$ is such substituent.

(7) The heat-developable image recording material as described n the above (6), wherein $R^{01}$ is not a hydrogen atom.

(8) The heat-developable image recording material as claimed in the above (6) or (7), wherein the substituted sulfonamidophenol compound is represented by the following formula (3):

Formula (3)

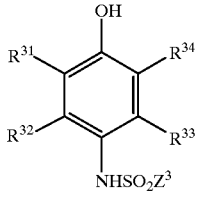

in the above formula, $R^{01}$ to $R^{04}$ independently represent a hydrogen atom; halogen atom, or substituent which is bound to the benzene ring via a carbon atom, oxygen atom, nitrogen atom, or sulfur atom; these substituents may be taken together with the adjacent ones or with a benzene ring to form a cyclic structure; and $Z^3$ represents an aliphatic, aromatic or heterocyclic group, (9) The heat-developable image recording material as described in any one of the above (1) to (8) wherein a photosensitive silver halide grain is contained; and

(10) The heat-developable image recording material as described in any one of the above (1) to (9) wherein an ultrahigh contrast agent is contained.

The heat-developable image recording material of the present invention allows rapid processing, has a small dependence on heat-development temperature, has a small lability against non-uniform temperature distribution in the developing apparatus, and can stably yield at uniform image. It is in particular desirable for printing plate making since it can produce an image with an ultrahigh contrast and an excellent uniformity.

DETAILED DESCRIPTION OF THE INVENTION

The present invention will be detailed hereinafter.

The heat-developable image recording material of the present invention has on a support an image-forming layer containing organic silver salt, and preferably has on the same side with this layer a photosensitive layer containing a photosensitive silver halide, and more preferably the image-forming layer coincides with the photosensitive layer.

The present inventors extensively investigated into the rate of the heat development for heat-developable image recording material containing an organic silver salt, a reducing agent and an organic binder at different temperatures, and finally found that heat-developable image recording materials of the conventional composition produce an image in a relatively abrupt manner after a certain inductive period instead of continuously producing an image with the elapse of development time. It was also found that the inductive period varied with the development temperature, and it was then supposed that fluctuations in the development temperature would result in alteration of the image density thereby to cause non-uniformity of the density. Thus the inventors aimed at solving the problem by constituting a superadditive developing agent system employed by the conventional wet development system using a developing solution for silver halide photosensitive material. Known superadditive developing agent systems in the wet development system include combinations of the compounds conforming to Kendall-Pelz Rule such as hydroquinones, aminophenols and pyrazolidones; such combinations being exemplified as hydroquinone as combined with phenidone (known as PQ developing solution) and Metol as combined with phenidone (known as MQ developing solution).

On the other hand, phenol derivatives preferably employed as a reducing agent for the development of a heat-developable image recording agent for the development of a heat-developable image recording material using an organic silver salt does not conform to Kendall-Pelz Rule, and there is no known reducing agent exhibiting superadditivity in such system. Moreover, neither effects such as improvement in the temperature dependence of the heat development nor improvement in the temperature non-uniformity of the heat developing apparatus is ever known. The term "superadditivity" in the context of the present invention is defined as same as that for superadditive developing agent in the wet developing system for silver halide photosensitive material. That is, the term means that the developing power exhibited by a combined use of two reductive compounds is superior to the sum of the developing powers separately exhibited by independent uses thereof.

The present inventors first found out a combination of reducing agents exhibiting superadditivity effectively used for the development of the heat-developable image recording material using an organic silver salt, and the confirmed that use of such combination can successfully improve the dependence on the heat development temperature and non-uniform temperature distribution of the heat developing apparatus.

A combination of reductive compounds exhibiting superadditivity was determined by fixing as one compound a hindered phenol compound which has been known as a reducing agent for the conventional heat-developable image recording material and by searching the other compound to be combined therewith. This resulted in finding a substituted sulfonamidophenol compounds. A desirable effect was obtained when the hindered phenol compound was used as a main reductive compound in an amount of $1\times10^{-2}$ to 10 mol per one mol of silver, and the substituted sulfonamidephenol compound was used as an auxiliary reductive compound in an amount of $1\times10^{-4}$ to $1\times10^{-1}$ mol per one mol of silver. A ratio of the substituted sulfonamidophenol compound to the hindered phenol compound is preferably within a range from 0.1 to 50 mol %, and more preferably from 0.5 to 20 mol %. Here, the amount of silver means a total amount of silver ascribable to the organic silver salt and silver halide.

In the description below, one reductive compound used in a larger amount will be denoted as a major reductive compound and the other reductive compound used in a lesser amount as an auxiliary reductive compound.

Effects of the present invention is not specific to the above combination but is, as judged from the above mechanism, intrinsically obtainable if the combination comprises reductive compounds exhibiting superadditively. Thus the scope of the present invention widely extends to general combination of reductive compounds exhibiting superadditivity.

Next the combination of two or more reductive compounds exhibiting superadditivity will be explained.

The main reductive compound can be selected from a variety of known reducing agents. While conventional photographic developers such as phenidone, hydroquinone and datechol are also useful, hindered phenol compound is preferable. A layer to which the reductive compound is added may be any layer on the surface having the image-forming layer. The reductive compound may also be a so-called precursor which is derived to effectively exhibit its function only at the time of development. Other wide variety of the reductive compounds are disclosed, for example, in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-108654, JP-A-56-146133, JP-A-57-82828, JP-A-57-82829, JP-A-6-3793 (the code "JP-A" as used herein means an "unexamined published Japanese patent application"), U.S. Pat. Nos. 3,667,9586, No. 3,679,426, No. 3,751,252, No. 3,751,255, No. 3,761,270, No. 3,782,949, No. 3,839,048, No. 3,928,686 and No. 5,464,738, German Patent No. 2,321,328 and European Patent No. 692,732. Examples thereof include amidoxines such as phenylamidozime, 2-thienylamindozime and p-phenoxyphenylamidoxime; azines such as 4-hydroxy-3,5-dimethoxybenzalidehyde azine; combinations of an aliphatic carboxylic acid arylhydrazide with an ascorbic acid, such as a combination of 2,2'-bis(hydroxymethyl) propionyl-β-phenylhydrazine with ascorbic acid; combinations of polyhydroxybenzene with hydroxylamine, reductance and/or hydrazine (e.g. combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of azine and sulfonamidophenol (e.g. combination of phenothiazine an 2,6-dichloro-4-benzenesulfonamidophenyl); α-cyanophenylacetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl)methane; combinations of bis-β-naphthol with 1,3-dihydroxybenzene derivative (e.g. 2,4-dihydroxybenzophenone or 2',4'-dihydroxyacetophenone); 5-pyrazolones such as 3-methyl-1-phenyl-5-pyrazolone; reductones such as dimethylaminohexose reductone, anhydrodihydroaminohexose reductone and anhydrodihydro-piperidinohexose reductone; sulfonamidophenol reductive compounds such as 2,6-dichloro-4-benzenesulfonamidophenol and p-benzenesulfonamidophenol; 2-phenylindane-1,3-dione or the like; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenol) methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl) propane; ascorbic acid derivatives such as 1-ascorbyl palmitate and ascorbyl stearate; aldehydes and ketones having benzyl and biacetyl groups; 3-pyrazolidone and a certain kind of indane-1,3-diones; and chromanols (e.g. tocopherol). More preferable reductive compounds are bisphenoland chromanols.

More preferable reductive compounds refer to a hindered phenol compound having at least one phenolic hydroxyl group, ortho position of which being substituted by a substituent other than a hydrogen atom. One or more phenol ring(s) may exist within one molecule. Specific examples of exceptionally preferable reducing agents are those expressed by the general formulae (Ia), (Ib), (IIa), (IIb), (III), (IVa) and (IVb) in the paragraphs of [0062] to [0074] of JP-A-9-274274.

Specific examples thereof are listed below, while not being limited thereto. Besides these, also available is 1,1-bis(2-hydroxy-3,5-dimethylphenyl)-3,5,5-trimethylhexane which is used in the Example described later. In the following tables, TMB denotes 1,3,3-trimethylbutyl group —CH(—$CH_3$)—$CH_2$—CH($CH_3$)$_2$, Cpen denotes cyclopentyl group, Chex denotes cyclohexyl group and DHP denotes 2,4-dihydroxyphenyl group.

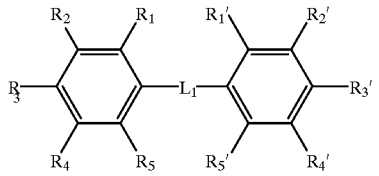

| No. | $R_1$, $R_1'$ | $R_2$, $R_2'$ | $R_3$, $R_3'$ | $R_4$, $R_4'$ | $R_5$, $R_5'$ | $L_1$ | $R_5$ |
|---|---|---|---|---|---|---|---|
| R-I-1 | —OH | —$CH_3$ | —H | —$CH_3$ | —H | CH—$R_5$ | —H |
| R-I-2 | —OH | —$CH_3$ | —H | —$CH_3$ | —H | CH—$R_5$ | —$CH_3$ |
| R-I-3 | —OH | —$CH_3$ | —H | —$CH_3$ | —H | CH—$R_5$ | —$C_3H_7$ |
| R-I-4 | —OH | —$CH_3$ | —H | —$CH_3$ | —H | CH—$R_5$ | —$C_6H_{11}$ |
| R-I-5 | —OH | —$CH_3$ | —H | —$CH_3$ | —H | CH—$R_5$ | —TMB |

-continued

| | | | | | | | |
|---|---|---|---|---|---|---|---|
| R-I-6 | —OH | —$CH_3$ | —H | —$CH_3$ | —H | CH—$R_5$ | —$C_4H_{19}$ |
| R-I-7 | —OH | —$CH_3$ | —H | —$CH_3$ | —H | S | — |
| R-I-8 | —OH | —$CH_3$ | —H | —$C_2H_5$ | —H | S | — |
| R-I-9 | —OH | —$C_4H_{9(t)}$ | —H | —$C_4H_9$(t) | —H | S | — |
| R-I-10 | —OH | —$C_4H_{9(t)}$ | —H | —$CH_3$ | —H | CH—$R_5$ | —H |
| R-I-11 | —OH | —$C_4H_{9(t)}$ | —H | —$CH_3$ | —H | CH—$R_5$ | —$CH_3$ |
| R-I-12 | —OH | —$C_4H_{9(t)}$ | —H | —$CH_3$ | —H | CH—$R_5$ | —TMB |
| R-I-13 | —OH | —$C_4H_{9(t)}$ | —H | —$C_2H_5$ | —H | CH—$R_5$ | —Ph |
| R-I-14 | —OH | —CHex | —H | —$CH_3$ | —H | S | — |
| R-I-15 | —OH | —$C_4H_{9(t)}$ | —H | —$C_2H_5$ | —H | S | — |
| R-I-16 | —OH | —$C_2H_6$ | —H | —$C_4H_{9(t)}$ | —H | CH—$R_5$ | —H |
| R-I-17 | —OH | —$C_2H_6$ | —H | —$C_4H_{9(t)}$ | —H | CH—$R_5$ | —$CH_3$ |
| R-I-18 | —OH | —$C_2H_6$ | —H | —$C_4H_{9(t)}$ | —H | CH—$R_5$ | —TMB |
| R-I-19 | —OH | —$CH_3$ | —H | —$C_4H_{9(t)}$ | —H | CH—$R_5$ | —Ph |
| R-I-20 | —OH | —$CH_3$ | —Cl | —$C_4H_{9(t)}$ | —H | CH—$R_5$ | —H |
| R-I-21 | —OH | —$CH_3$ | —H | —$C_4H_{9(t)}$ | —$OCH_3$ | CH—$R_5$ | —H |
| R-I-22 | —H | —$C_4H_{9(t)}$ | —OH | —CPen | —H | CH—$R_5$ | —H |
| R-I-23 | —H | —$C_4H_{9(t)}$ | —OH | —$C_4H_9$(t) | —H | CH—$R_5$ | —TMB |
| R-I-24 | —H | —$C_4H_{9(t)}$ | —OH | —H | —H | CH—$R_5$ | —H |
| R-I-25 | —H | —$C_4H_{9(t)}$ | —OH | —H | —H | CH—$R_5$ | —$C_3H_7$ |
| R-I-26 | —H | —$CH_3$ | —OH | —$C_4H_9$(t) | —H | CH—$R_5$ | —TMB |
| R-I-27 | —H | —$C_2H_5$ | —OH | —$C_4H_9$(t) | —H | CH—$R_5$ | —H |
| R-I-28 | —H | —$CH_3$ | —OH | —$C_2H_5$ | —H | CH—$R_5$ | —TMB |
| R-I-29 | —H | —$CH_3$ | —OH | —$CH_3$ | —H | S | — |
| R-I-30 | —H | —$CH_3$ | —OH | —$CH_3$ | 13 Cl | S | — |
| R-I-31 | —H | —$CH_3$ | —OH | —$C_2H_5$ | —H | S | — |
| R-I-32 | —H | —$C_2H_6$ | —OH | —$C_2H_5$ | —H | S | — |
| R-I-33 | —H | —$C_2H_6$ | —OH | —$CH_3$ | —Cl | S | — |
| R-I-34 | —H | —$CH_3$ | —OH | —$C_4H_{9(t)}$ | —H | S | — |
| R-I-35 | —H | —CHeX | —OH | —$C_4H_{9(t)}$ | —H | S | — |

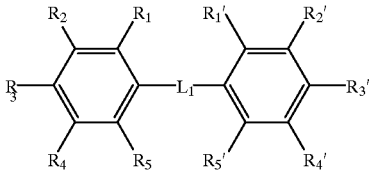

| No. | $R_1$ | $R_2$ | $R_3$ | $R_4$ | $R_5$ | $R_1'$ | $R_2'$ | $R_3'$ | $R_4'$ | $R_5'$ | $L_1$ | $R_6$ |
|---|---|---|---|---|---|---|---|---|---|---|---|---|
| R-I-36 | —OH | —$CH_3$ | —H | —$CH_3$ | —H | —H | —$CH_3$ | —OH | —$CH_3$ | —H | CH—$R_6$ | —H |
| R-I-37 | —OH | —$C_4H_9$(t) | —H | —$CH_3$ | —H | —H | —CH | —OH | —H | CH—$R_6$ | —H | |
| R-I-38 | —OH | —$CH_3$ | —H | —$CH_3$ | —H | —H | —CHex | —OH | —$CH_3$ | —H | CH—$R_6$ | —$CH_3$ |
| R-I-39 | —OH | —$C_4H_{9(t)}$ | —H | —$CH_3$ | —H | —H | —$CH_3$ | —OH | —$CH_3$ | —H | CH—$R_6$ | —$CH_3$ |
| R-I-40 | —OH | —$CH_3$ | —H | —$CH_3$ | —H | —H | —$CH_3$ | —OH | —$CH_3$ | —H | CH—$R_6$ | —TMB |
| R-I-41 | —OH | —$C_4H_9$(t) | —H | —$CH_3$ | —H | —H | —$CH_3$ | —OH | —$CH_3$ | —H | CH—$R_6$ | —TMB |
| R-I-42 | —OH | —$CH_3$ | —H | —$CH_3$ | —H | —H | —$CH_3$ | —OH | —$CH_3$ | —H | S | — |
| R-I-43 | —OH | —$C_4H_9$(t) | —H | —$CH_3$ | —H | —H | —$CH_3$ | —OH | —$CH_3$ | —H | S | — |
| R-I-44 | —OH | —$CH_3$ | —H | —$CH_3$ | —H | —H | —CHex | —OH | —$CH_3$ | —H | S | — |

R-I-45

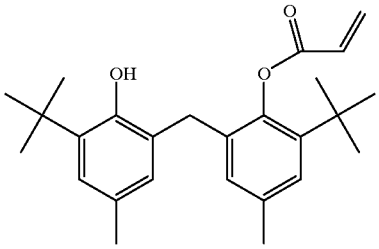

R-I-46

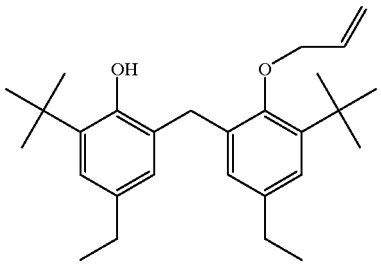

R-I-47

R-I-48

-continued

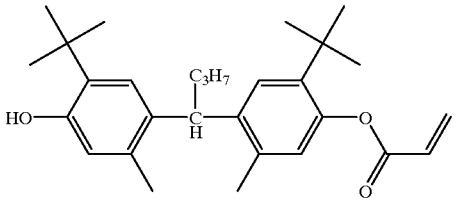

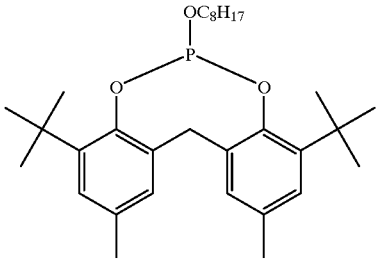

R-I-49

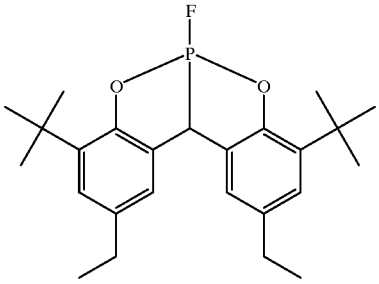

R-I-50

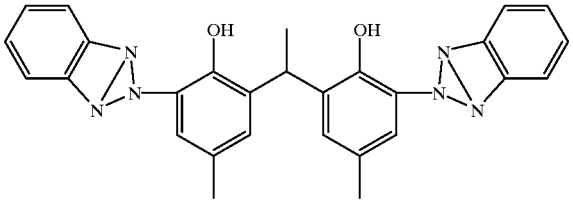

R-I-51

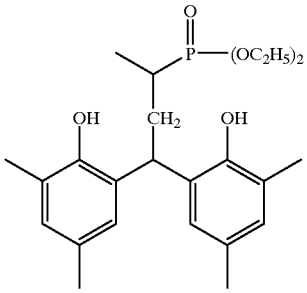

R-I-52

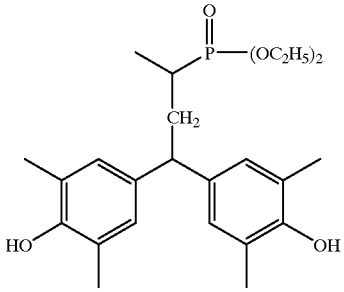

R-I-53

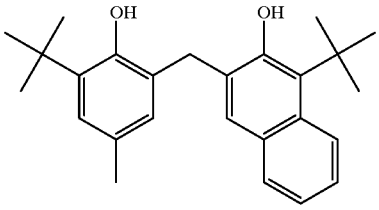

R-I-54

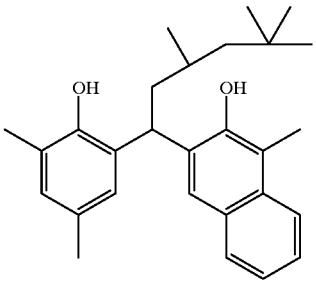

R-I-55

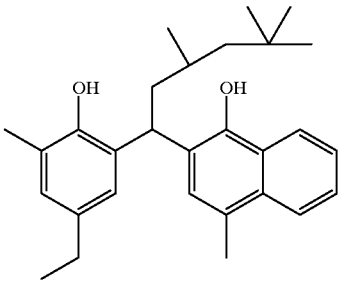

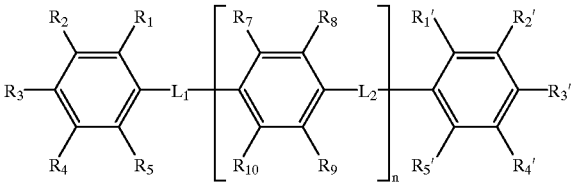

| No. | $R_1$, $R_1'$ | $R_2$, $R_2'$ | $R_3$, $R_3'$ | $R_4$, $R_4'$ | $R_5$, $R_5'$ | $R_7$ | $R_8$ | $R_9$ | $R_{10}$ | $L_1$ | $R_6$ | $L_2$ | $R_6'$ | n |
|---|---|---|---|---|---|---|---|---|---|---|---|---|---|---|
| R-II-1 | —OH | —$C_4H_9$(t) | —H | —$CH_3$ | —H | —OH | —$CH_3$ | —$CH_3$ | —H | CH—$R_6$ | —H | CH—$R_6'$ | —$CH_3$ | 1 |
| R-II-2 | —OH | —$CH_3$ | —H | —$CH_3$ | —H | —OH | —$C_2H_5$ | —$CH_3$ | —H | CH—$R_6$ | —TMB | CH—$R_6'$ | —$CH_3$ | 1 |
| R-II-3 | —OH | —$C_4H_9$(t) | —H | —$CH_3$ | —H | —OH | —$CH_3$ | —$CH_3$ | —H | CH—$R_6$ | —H | CH—$R_6'$ | —TMB | 3 |
| R-II-4 | —OH | —$CH_3$ | —H | —$CH_3$ | —H | —OH | —$C_2H_5$ | —$CH_3$ | —H | CH—$R_6$ | —TMB | CH—$R_6'$ | —TMB | 2 |
| R-II-5 | —H | —$C_4H_9$(t) | —OH | —$CH_3$ | —H | —OH | —$CH_3$ | —$CH_3$ | —H | S | — | CH—$R_6'$ | —$CH_3$ | 1 |
| R-II-6 | —H | —$CH_3$ | —OH | —$CH_3$ | —H | —OH | —$C_2H_5$ | —$CH_3$ | —H | S | — | S | — | 1 |

-continued

| | | | | | | | | | | | | | | |
|---|---|---|---|---|---|---|---|---|---|---|---|---|---|---|
| R-II-7 | —H | —$C_4H_9$(t) | —OH | —$CH_3$ | —H | —OH | —$CH_3$ | —$CH_3$ | —H | S | — | S | — | 2 |
| R-II-8 | —H | —$CH_3$ | —OH | —$CH_3$ | —H | —OH | —$C_2H_5$ | —$CH_3$ | —H | S | — | CH—$R_6$' | —TMB | 3 |

(Z-1)

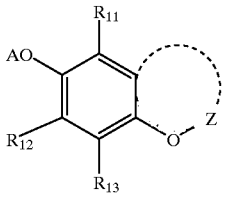

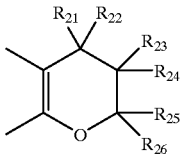

| No. | Z | $R_{11}$ | $R_{12}$ | $R_{13}$ | $R_{21}$ | $R_{22}$ | $R_{23}$ | $R_{24}$ | $R_{25}$ | $R_{26}$ | A |
|---|---|---|---|---|---|---|---|---|---|---|---|
| R-III-1 | Z-1 | —$CH_3$ | —$CH_3$ | —$CH_3$ | —H | —H | —H | —H | —$CH_3$ | —$C_{16}H_{33}$ | —H |
| R-III-2 | Z-1 | —$CH_3$ | —$CH_3$ | —$CH_3$ | —H | —H | —H | —H | —$CH_3$ | —$C_5H_{13}$ | —H |
| R-III-3 | Z-1 | —$CH_3$ | —$C_8H_{17}$ | —H | —H | —$CH_3$ | —H | —H | —$CH_3$ | —$CH_3$ | —H |
| R-III-4 | Z-1 | —H | —$C_8H_{17}$ | —H | —H | —$CH_3$ | —H | —H | —$CH_3$ | —$CH_3$ | —H |
| R-III-5 | Z-1 | —H | —H | —$CH_3$ | —H | —H | —H | —H | —$CH_3$ | —$C_{16}H_{20}$ | —H |
| R-III-6 | Z-1 | —H | —$CH_3$ | —H | —$CH_3$ | —$CH_3$ | —H | —H | —$CH_3$ | —$CH_3$ | —H |
| R-III-7 | Z-1 | —H | —$CH_3$ | —H | —$CH_3$ | —$CH_3$ | —H | —H | —$CH_3$ | —DHP | —H |

(Z-2)

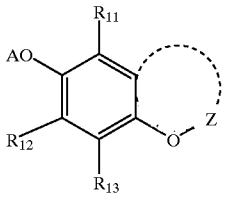

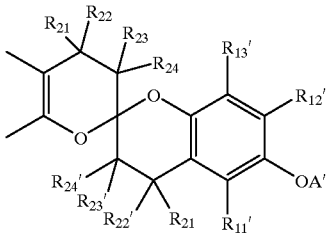

| No. | Z | $R_{11}$, $R_{11}$' | $R_{12}$, $R_{12}$' | $R_{13}$, $R_{13}$' | $R_{21}$, $R_{21}$ | $R_{21}$', $R_{23}$' | $R_{23}$, $R_{24}$ | $R_{13}$', $R_{14}$' | A |
|---|---|---|---|---|---|---|---|---|---|
| R-III-8 | Z-2 | —H | —$CH_3$ | —H | —$CH_3$ | —$CH_3$ | —H | —H | —H |
| R-III-9 | Z-2 | —$CH_3$ | —$CH_3$ | —$CH_3$ | —H | —H | —$CH_3$ | —$CH_3$ | —H |
| R-III-10 | Z-2 | —$CH_3$ | —$CH_3$ | —$CH_3$ | —H | —H | —H | —H | —H |
| R-III-11 | Z-2 | —$CH_3$ | —OH | —$CH_3$ | —$CH_3$ | —$CH_3$ | —H | —H | —H |
| R-III-12 | Z-2 | —H | —OH | —$CH_3$ | —$CH_3$ | —$CH_3$ | —H | —H | —H |

(Z-3)

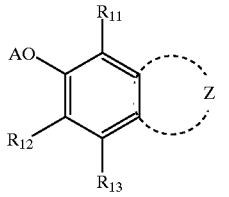

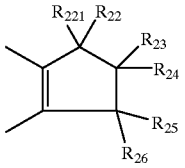

| No. | Z | $R_{11}$ | $R_{12}$ | $R_{13}$ | $R_{21}$, $R_{22}$ | $R_{23}$, $R_{22}$ | $R_{25}$, $R_{26}$ | A |
|---|---|---|---|---|---|---|---|---|
| R-IV-1 | Z-3 | —H | —OH | —$CH_3$ | —$CH_3$ | —H | —H | —H |
| R-IV-2 | Z-3 | —$CH_3$ | —$CH_3$ | —$CH_3$ | —$CH_3$ | —H | —H | —H |

-continued (Z-4)

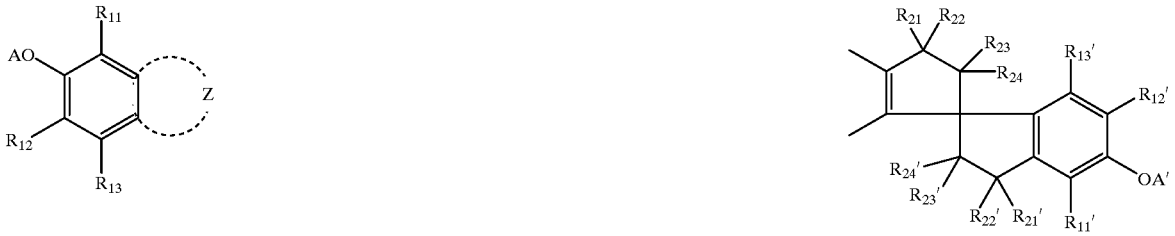

| No. | Z | $R_{11}$, $R_{11}'$ | $R_{12}$, $R_{12}'$ | $R_{13}$, $R_{13}'$ | $R_{21}$, $R_{21}'$ | $R_{22}$, $R_{22}'$ | $R_{23}$, $R_{24}$ | $R_{23}'$, $R_{24}'$ | A |
|---|---|---|---|---|---|---|---|---|---|
| R-IV-3 | Z-4 | —$CH_3$ | —H | —H | —$CH_3$ | —$CH_3$ | —H | —H | —H |
| R-IV-4 | Z-4 | —$CH_3$ | —$CH_3$ | —H | —$CH_3$ | —$CH_3$ | —H | —H | —H |
| R-IV-5 | Z-4 | —$CH_3$ | —H | —H | —$C_2H_6$ | —$CH_3$ | —H | —H | —H |

When an ultrahigh contrast agent is used in the present invention, a molar ratio of the reducing agent and the ultrahigh contrast agent is preferably set within a range from $1\pm10^{-1}$ to $1:10^{-1}$.

The description below relates to the substituted sulfonamidophenol compound as an example of the auxiliary reductive compound used in the present invention. Preferably is a compound expressed by the formula (1).

Formula (1)

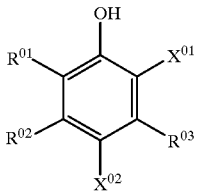

In the formula (1), $X^{01}$ and $X^{02}$ independently represents a hydrogen atom; halogen atom, or substituent which is bound to the benzene ring via carbon atom, oxygen atom, nitrogen atom, or sulfur atom; at least either of which being a sulfonamido group.

$R^{01}$, $R^{02}$ and $R^{03}$ independently represent a hydrogen atom; halogen atom, or substituent which is bound to the benzene ring via a carbon atom, oxygen atom, nitrogen atom, or sulfur atom. These substituents may may be taken together with the adjacent ones or with a benzene ring to form acyclic structure. At least one of $X^{01}$, $X^{02}$, $R^{01}$, $R^{02}$ and $R^{03}$ is such substituent.

The formula (1) will be detailed hereinafter.

The substituent expressed by $X^{01}$, $X^{021}$, $R^{01}$, $R^{02}$ or $R^{03}$ is a group bound to the benzene ring via a carbon atom, oxygen atom, nitrogen atom, or sulfur atom.

Examples of the substituent bound to the benzene ring via a carbon atom include alkyl group, alkenyl group, alkynyl group, aryl group, carbamoyl group; alkoxycarbonyl group, aryloxycarbonyl group, acyl group, carboxyl group, cyano group and heterocyclic group; those via an oxygen atom include hydroxyl group, alkoxy group, aryloxy group, heterocyclic oxy group, acyloxy group, carbamoyloxy group and sulfonyloxy group; those via a nitrogen atom include acylamino group, amino group, alkylamino group, arylamino group, heterocyclic amino group, ureide group, sulfamoylamino group, alkoxycarbonylamino group, aryloxycarbonylamino group, sulfonamino group, imido group, heterocyclic group and nitro group; and those via a sulfur atom include alkylthio group, arylthio group, heterocyclic thio group, sulfamoyl group, alkoxysulfonyl group, aryloxysulfonyl group, sulfonyl group, sulfo group and sulfinyl group. All of these substituents may further be substituted with these substituents.

The formula (1) will further be detailed. The halogen atom is exemplified as a fluorine atom, chlorine atom or bromine atom. The alkyl group has a normal, branched or cyclic structure having a carbon number of 1 to 18 and preferably 1 to 10; examples of which include ethyl, isopropyl, t-butyl, benzyl and cyclopentyl groups. The alkenyl group has a carbon number of 2 to 16, and examples of which include vinyl, 1-propenyl, 1-hexenyl and styryl groups. The alkynyl group has a carbon number of 2 to 16, and examples of which include ethynyl, 1-butynyl and phenylethynyl groups. The aryl group has a carbon number of 6 to 16, and examples of which include phenyl, naphthyl and p-methoxyphenyl groups.

The carbamoyl group has a carbon number of 1 to 18, and examples of which include carbamoyl, N-ethylcarbamoyl, N-propylcarbamoyl, N-butylcarbamoyl, N-dibutylcarbamoyl and N-phenylcarbamoyl groups. The alkoxycarbonyl group has a carbon number of 2 to 18, and examples of which include methoxycarbonyl, ethoxycarbonyl and benzyloxycarbonyl groups. The aryloxycarbonyl group has a carbon number of 7 to 18 and can be exemplified as phenoxycarbonyl group. The acyl group has a carbon number of 1 to 18, and examples of which include acetyl and benzoyl groups. The heterocyclic group bound via a carbon atom in the ring thereof has a five- or six-membered saturated or unsaturated heterocyclic structure with a carbon number of 1 to 5 containing one or more oxygen atom(s), nitrogen atom(s) or sulfur atom(s), number and kind of such hetero atoms constituting the ring being one or more, and examples of which include 2-furyl, 2-thienyl, 2-pyridyl and 2-imidazolyl groups.

The alkoxy group has a carbon number of 1 to 18, preferably 1 to 10, and examples of which include 2-methoxyethoxy, and 2-methanesulfonylethoxy groups. The aryloxy group has a carbon number of 6 to 16, and examples of which include phenoxy, p-methoxyphenoxy, m-(3-hydroxypropionamido)phenoxy groups. The heterocyclic oxy group has a five- or six-membered saturated or unsaturated heterocyclic structure with a carbon number of 1 to 5 containing one or more oxygen atom(s), nitrogen atom(s) or sulfur atom(s), number and kind of such hetero atoms constituting the ring being one or more, and examples of which include 1-phenyltetrazolyl-5-oxy, 2-tetrahydropyranyloxy and 2-pyridyloxy groups. The acyloxy group has a carbon number of 1 to 16, preferably 1 to 10, and examples of which includes acetoxy, benzoyloxy and 4-hydroxybutanoyloxy groups. The carbamoyloxy group has a carbon number of 1 to 16, preferably 1 to 10, and examples of which include N,N-dimethylcarbamoyloxy, N-butylcarbamoyloxy and N-phenylcarbamoyloxy groups. The sulfonyloxy group has a carbon number of 1 to 16, and examples of which include methanesulfonyloxy and benzenesulfonyloxy groups.

The acylamino group has a carbon number of 1 to 18, preferably 1 to 10, and examples of which include acetylamino, hexylcarbonylamino and benzoylamino groups. The alkylamino group has a carbon number of 1 to 16, preferably 1 to 10, and examples of which include N,N-dimethylamino, N-(2-hydroxyethyl)amino and N-(3-dimethylaminopropyl)amino groups. The arylamino group has a carbon number of 6 to 16 and examples of which include anilino and N-methylaminolino groups. The heterocyclic amino group has a five- or six-membered saturated or unsaturated heterocyclic structure with a carbon number of 1 to 5 containing one or more oxygen tom(s), nitrogen atom(s) or sulfur atom(s), number and kind of such hetero atoms constituting the ring being one or more, and examples of which include 2-oxazolylamino, 2-tetrahydroxyranylamino and 4-pyridylamino groups. The ureide group has a carbon number of 1 to 16, preferably 1 to 10, and examples of which include ureide, methylureide, N,N-diethylureide and 2-methansulfonamidoethyl ureide groups.

The sulfamoyl group has a carbon number of 0 to 16, preferably 0 to 10, and examples of which include methylsulfamoylamino and 2-methoxyethylsulfamoylamino groups. The alkoxycarbonylamino group has a carbon number of 2 to 16, preferably 2 to 10 and is exemplified as methoxycarbonylamino group. The aryloxycarbonylamino group has a carbon number of 7 to 18, and examples of which include phenoxycarbonylamine and 2,6-dimethoxyphenoxycarbonylamino groups. The sulfonamide group has a carbon number of 1 to 18, preferably 1 to 10, and examples of which include methanesulfonamide and p-toluenesulfonamide groups. The imido group has a carbon number of 4 to 16, and examples of which include N-succinimido and N-phthalimido groups. The heterocyclic group bound via a nitrogen atom in the ring thereof has a five- or six-membered saturated or unsaturated heterocyclic structure consisting of nitrogen atom and at least one kind of carbon, oxygen and sulfur atoms, and examples of which include pyrrolidino, morpholino and imidazolino groups.

The alkylthio group has a carbon number of 1 to 16, preferably to 10, and examples of which include methylthio and 2-carboxyethylthio groups. The arylthio group has a carbon number of 6 to 18, and examples of which include phenylthio and 2-carboxyphenylthio groups. The heterocyclic thio group has a five- or six-membered saturated or unsaturated heterocyclic structure with a carbon number of 1 to 5 containing one or more oxygen atom(s), nitrogen atom(s) or sulfur atom(s), number and kind of such hetero atoms constituting the ring being one or more, and examples of which include 2-benzothiazolylthio and 2-pyridylthio groups.

The sulfamoyl group has a carbon number of 0 to 16, preferably 0 to 10, and examples of which include sulfamoyl, methylsulfamoyl and phenylsulfamoyl groups. The alkoxysulfonyl group has a carbon number of 1 to 16, preferably 1 to 10, and is exemplified as methoxysulfonyl group. The aryloxysulfonyl group has a carbon number of 6 to 18, preferably 6 to 10 and is exemplified as phenoxysulfonyl group. The sulfonyl group has a carbon number of 1 to 18, preferably 1 to 10, and examples of which include methanesulfonyl and benzenesulfonyl groups. The sulfinyl group has a carbon number of 1 to 18, preferably 1 to 10, and examples of which include methanesulfinyl and benzenesulfinyl groups.

A ring which may be formed by the adjacent groups selected from those expressed by $X^{01}$, $X^{02}$ and $R^{01}$ to $R^{03}$ is exemplified as cyclohexene, 3,4-dihydro-2(1H)-pyridinone, bicyclo[2.2.1]heptene and 1,3-dioxolene.

The group expressed by $X^{01}$, $X^{02}$, $R^{01}$, $R^{02}$ or $R^{03}$ is preferably a hydrogen atom, halogen atom, alkyl group, aryl group, carbamoyl group, alkoxycarbonyl group, acyl group, cyano group, alkoxy group, aryloxy group, acylamino group, ureide group, sulfamoylamino group, sulfonamide group, nitro group, alkylthio group, arylthio group, sulfamoyl group or sulfonyl group; more preferably a hydrogen atom, halogen atom, alkyl group, cyano group, alkoxy group, aryloxy group, acylamino group, ureide group, sulfonamido group or alkylthio group; and most preferably a hydrogen atom, halogen atom, alkyl group, cyano group, alkoxy group or sulfonamido group.

At least either $X^{01}$ or $X^{02}$ represents a sulfonamido group, a part of examples of which being already described. In more details, the examples include groups derived from amides of aliphatic sulfonic acid, aromatic hydrocarbon sulfonic acid and heterocyclic sulfonic acid, and these groups may further be substituted with the group described as the substituent for $R^{01}$. The aliphatic sulfonamido group has an alkane, alkene or alkynesulfonamide having a normal, branched or cyclic structure with a carbon number of 1 to 18, preferably 1 to 10, and examples of which include methanesulfonamido, butanesulfonamido, octanesulfonaimdo, dodecanesulfonamido, 2-butanesulfonamido, cyclohexanesulfonamido, 3-phenoxypropanesulfonamido and benzylsulfonamido groups.

The aromatic hydrocarbon sulfonamide group has an aromatic hydrocarbon monocyclic or condensed ring structure with a carbon number of 6 to 16, preferably 6 to 12, and examples of which include benzenesulfonamido, toluenesulfonamido, 2,4,6-tripropylbenzenesulfonamido, methoxybenzenesulfonamido, chlorobenzenesulfonamido, acetamidobenzenesulfonamido and naphthalenesulfonamido groups.

The heterocyclic sulfonamido group has a five- or six-membered saturated or unsaturated monocyclic or condensed ring with a carbon number of 1 to 5 containing one or more oxygen atom(s), nitrogen atom(s) or sulfur atom(s). Examples of the five-membered heterocyclic structure include those derived from thiophene, pyrazole, imidazole, oxazole, thiazole, triazole, indazole, benzimidazole, benztriazole, benzoxazole, benzothiazole and pyrazolotriazole. Examples of the six-membered heterocyclic structure include those derived from pyridine, pyrazine, pyrimidine, pyridazine, triazine, quinoline, isoquinoline, phthalazine and naphthylidine.

The sulfonamido group for $X^{01}$ or $X^{02}$ is preferably an aromatic hydrocarbon sulfonamido group or heterocyclic sulfonamido group.

A bis-form compound, preferably expressed by the formula (2) below, will be produced when an arbitrary hydrogen atom is eliminated from the compound expressed by the formula (1) to produce a radical (residue), and two of such radicals combine with each other.

Formula (2)

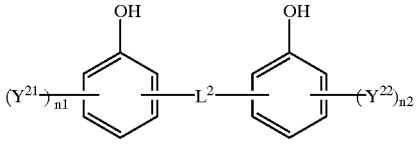

In the formula (2), $Y^{21}$ and $Y^{22}$ have the same meanings as $R^{01}$ or $X^{01}$ in the formula (1). Symbols $n^1$ and $n^2$ independently represent an integer from 1 to 4, and $Y^{21}$ and $Y^{22}$ may differ from each other when the integer is 2 or larger. $L^2$ represents a divalent linking group (alkylene group, alkenylene group, alkynylene group, arylene group, divalent heterocyclic group, and groups consisting of these groups linked with the individual or combination of —O—, —S—, —NH—, —CO—, —$SO_2$— or the like), which is obtained by combining two radicals independently generated after eliminating one hydrogen atom from an arbitrary substituent of the compound expressed by the formula (1). Here in the individual of these two phenol nuclei, at least one substituent on the ortho or para position of the OH group is a sulfonamide group, where preferable examples of which are same as those described in relation to the formula (1).

A preferable compound used in the present invention expressed by the formula (1) is given by the formula (3) below:

Formula (3)

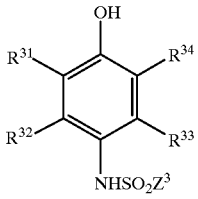

In the formula (3), $R^{31}$ to $R^{34}$ have the same meaning as $R^{01}$ in the formula (1). $Z^3$ represents an aliphatic, aromatic or heterocyclic group, and $NHSO_2Z^3$ has the same meaning as a sulfonamido group described for $X^{01}$ and $X^{02}$ in the formula (1), where preferable examples of which are same as those described in relation to the formula (1).

It has already been known in JP-A-10-221806 to use sulfonamidophenol compounds as a reducing agent in the heat-developable image recording material. The compound used as the auxiliary reductive compound in the present invention, however, differs from those both in function and preferable structure. The compound used in the present invention can be found in those showing substantially no function or showing only quite a weak developing power when used singly. Such compound can exhibit a strong developing power only when it is combined with the major reductive compound; such effect cannot be inferred from JP-A-10-221806 or other known literatures even by those skilled in the art.

An exceptionally preferable structure for the auxiliary reductive compound used in the present invention relates to that having a substituent on the ortho position of the hydroxyl group, that is, having $R^{01}$ representing a substituent other than a hydrogen atom.

Specific examples of the auxiliary reductive compound available in the present invention will be listed below, while being not limited thereto:

D-1

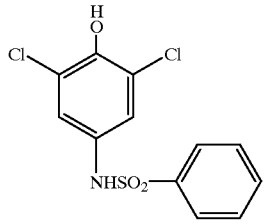

D-2

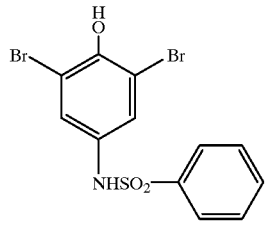

D-3

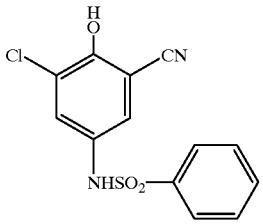

D-4

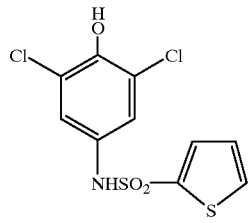

D-5

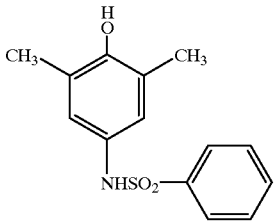

D-6

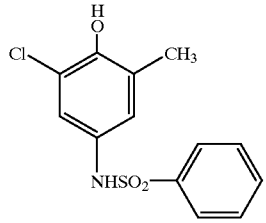

-continued

D-7

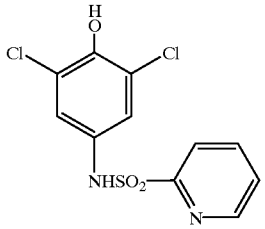

D-8

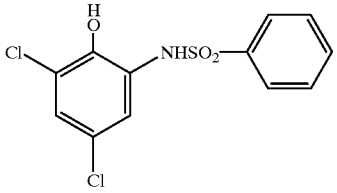

The auxiliary reductive compound may also be selected from the compounds described in JP-A-10-221806.

The reductive compound used in the present invention may be added in any form of solution, powder or solid microparticle dispersion. Dispersion of the solid microparticle is effected using a known pulverizing means (e.g. ball mill, vibrating ball mill, sand mill, colloid mill, jet mill and roller mill). A dispersion aid may be available for dispersing the solid microparticle.

Next paragraphs will describe the ultrahigh contrast agent used in the present invention. The ultrahigh contrast agents can be selected from various known compounds, which include hydrazines disclosed in, for example, U.S. Pat. No. 5,464,738, No. 5,496,695, No. 5,512,411, and No. 5,536,622, JP-B-6-77138 and JP-B-6-93082 (the code "JP-B" as used herein means an "examined Japanese patent publication"), JP-A-6-230497, JP-A-6-289520, JP-A-6-313951, JP-A-7-5610, JP-A-7-77783 and JP-A-7-104426; acrylonitrile derivatives disclosed in U.S. Pat. Nos. 5,545,515 and 5,635,339; malondialdehydes disclosed in U.S. Pat. No. 5,654,130; and isoxazoles disclosed in U.S. Pat. No. 5,705,324. Known development accelerators include amine compounds disclosed in U.S. Pat. No. 5,545,505; hydroxamic acids disclosed in U.S. Pat. No. 5,545,507; and hydrogen atom donors disclosed in U.S. Pat. No. 5,637,449. All these known materials are available for the present invention. More preferable ultrahigh contrast agents relate to a substituted alkene derivative, substituted isooxazole derivative and acetal derivative respectively expressed by the formulae (N1) to (N3) below:

Formula (N1)

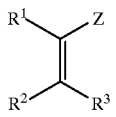

Formula (N2)

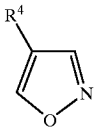

-continued

Formula (N3)

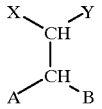

In the general formula (N1), $R^1$, $R^2$ and $R^3$ independently represent a hydrogen atom or substituent, and Z represents an electron attracting group. In the formula (N1), $R^1$ as bound with Z; $R^2$ as bound with $R^3$; $R^1$ as bound with $R^2$; or $R^3$ as bound with Z may form a cyclic structure. In the formula (N2), $R^4$ represents a substituent. In the formula (N3), X and Y independently represent a hydrogen atom or substituent; A and B independently represent alkoxy group, alkylthio group, alkylamino group, aryloxy group, arylthio group, anilino group, heterocyclic oxy group, heterocyclic thio group or heterocyclic amino group. In the formula (N3), X as bound with Y, and A as bound with B, may form a cyclic structure.

In the formula (N1), possible examples of $R^1$, $R^2$ and $R^3$ representing a substituent include halogen atom (fluorine atom, chlorine atom, bromine atom or iodine atom), alkyl group (including aralkyl group, cycloalkyl group and active methine group), alkenyl group, alkynyl group, aryl group, heterocyclic group (including N-substituted nitrogen-containing heterocyclic group), heterocyclic group containing a quaternized nitrogen atom (e.g. pyridinio group), acyl group, alkoxycarbonyl group, aryloxycarbonyl group, carbamoyl group, carboxyl group or salt thereof, imino group, imino group substituted by nitrogen atom, thiocarbonyl group, sulfonylcarbamoyl group, acylcarbamoyl group, sulfamoylcarbamoyl group, carbazolyl group, oxalyl group, oxamoyl group, cyano group, thiocarbamoyl group, hydroxyl group or salt thereof, alkoxy group (including a group containing repetitive units of ethylenoxy group or propylenoxy group), aryloxy group, heterocyclic oxy group, acyloxy group, (alkoxy or aryloxy)carbonyloxy group, carbamoyloxy group, sulfonyloxy group, amino group, (alkyl, aryl or heterocyclic)amino group, acylamino group, sulfonamide group, ureide group, thioureide group, isothioureide group, imido group, (alkoxy or aryloxy)carbonylamino group, sulfamoylamino group, semicarbazide group, thiosemicarbazide group, hydrazino group, quaternized ammonio group, oxamoylamino group, (alkyl or aryl) sulfonylureide group, acylureide group, acylsulfamoylamino group, nitro group, mercapto group, (alkyl, aryl or heterocyclic)thio group, acylthio group, (alkyl or aryl)sulfonyl group, (alkyl or aryl)sulfinyl group, sulfo group or salt thereof, sulfamoyl group, acyl sulfamoyl group, sulfonylsulfamoyl group or salt thereof, phosphoryl group, group containing phosphate amide or phosphate ester structure, silyl group and stannyl group. These substituents may further be substituted by these substituents.

The electron attracting group represented by Z in the formula (N1) is such substituent having a positive Hammett's substituent constant $\sigma_p$, which is typified as cyano group, alkoxycarbonyl group, aryloxycarbonyl group, carbamoyl group, imino group, imino group substituted by nitrogen atom, thiocarbonyl group, sulfamoyl group, alkylsulfonyl group, arylsulfonyl group, nitro group, halogen atom, perfluoroalkyl group, perfluoroalkanamide group, sulfonamide group, acyl group, formyl group, phosphoryl group, carboxyl group, sulfo group (or salt thereof), heterocyclic group, alkenyl group, alkynyl group, acyloxy group, acylthio group, sulfonyloxy group, or aryl group substituted by these electron attracting groups. Here, the heterocyclic group is defined as aromatic or non-aromatic, saturated or unsaturated heterocyclic group, which is typified as pyridyl group, quinolyl group, quinoxalinyl group, pyradinyl group, benzotriazolyl group, imidazolyl group, benzimidazolyl group, hydantoin-1-yl group, urazole-1-yl group, succinimido group and phthalimido group. The electron attracting group expressed by Z in the formula (N1) may further have arbitrary substituent.

The electron attracting group represented by Z in the formula (N1) is preferably such that having a total carbon number of 0 to 30, which is typified as cyano group, alkoxycarbonyl group, aryloxycarbonyl group, carbamoyl group, thiocarbonyl group, imino group, imino group substituted by nitrogen atom, sulfamoyl group, alkylsulfonyl group, arylsulfonyl group, nitro group, perfluoroalkyl group, acyl group, formyl group, phosphoryl group, acyloxy group, acylthio group or phenyl group substituted by arbitrary electron attracting group. Among these more preferable are cyano group, alkoxycarbonyl group, carbamoyl group, thiocarbonyl group, imino group, imino group substituted by nitrogen atom, sulfamoyl group, alkylsulfonyl group, arylsulfonyl group, acyl group, formyl group, phosphoryl group, trifluoromethyl group or a phenyl group substituted by arbitrary electron attracting group; and still more preferably are cyano group, alkoxycarbonyl group, carbamoyl group, imino group, imino group substituted by nitrogen atom, alkylsulfonyl group, arylsulfonyl group, acyl group and formyl group.

The substituent represented by $R^1$ in the formula (N1) is preferably a group having a total carbon number of 0 to 30, which is exemplified as a group based on the same definition as the above-described electron attracting group represented by Z in the formula (N1), as well as alkyl group, alkenyl group, alkoxy group, aryloxy group, heterocyclic oxy group, alkylthio group, arylthio group, heterocyclic thio group, amino group, alkylamino group, arylamino group, heterocyclic amino group, ureide group, acylamino group, silyl group, or substituted or unsubstituted aryl group. Among these, more preferable are a group based on the same definition as the above-described electron attracting group represented by Z in the formula (N1), as well as substituted or unsubstituted aryl group, alkenyl group, alkylthio group, arylthio group, alkoxy group, silyl group and acylamino group; and still more preferable are electron attracting group, aryl group, alkenyl group and acylamino group.

When $R^1$ represents an electron attracting group, preferable range thereof is the same with that for the electron attracting group represented by Z.

The substituent represented by $R^2$ or $R^3$ in the formula (N1) is preferably a group based on the same definition as the above-described electron attracting group represented by Z in the formula (N1), as well as alkyl group, hydroxyl group (or salt thereof), mercapto group (or salt thereof), alkoxy group, aryloxy group, heterocyclic oxy group, alkylthio group, arylthio group, heterocyclic thio group, amino group, alkylamino group, anilino group, heterocyclic amino group, acylamino group, and substituted or unsubstituted phenyl group. It is more preferable that either $R^2$ or $R^3$ represents a hydrogen atom and the other represents a substituent. Such substituent is preferably an alkyl group, hydroxyl group (or salt thereof), mercapto group (or salt thereof), alkoxy group, aryloxy group, heterocyclic oxy group, alkylthio group, arylthio group, heterocyclic thio group, amino group, alkylamino group, anilino group, heterocyclic amino group, acylamino group (more specifically, perfluoroalkanamide group), sulfonamide group, substituted or unsubstituted phenyl group or heterocyclic group. Still more preferable are hydroxyl group (or salt thereof), mercapto group (or salt thereof), alkoxy group, aryloxy group, heterocyclic oxy group, alkylthio group, arylthio group, heterocyclic thio group, amino group, and heterocyclic group; and most preferable are hydroxyl group (or salt thereof), alkoxy group and heterocyclic group.

It is also preferable that Z as bound with $R^1$; or $R^2$ as bound with $R^3$ in the formula (N1) may form a cyclic structure. The cyclic structure thus formed is an aromatic or non-aromatic heterocycle, preferably having a five- to seven-membered cyclic structure, preferably having a total carbon number of 1 to 40 inclusive of its substituent, and more preferably 3 to 35.

Among the compounds expressed by the formula (N1), one more preferable example is a compound in which Z represents any one of cyano group, formyl group, acyl group, alkoxycarbonyl group, imino group and carbamoyl group; $R^1$ represents an electron attracting group; either $R^2$ or $R^3$ represents a hydrogen atom and the other represents any one of hydroxyl group (or salt thereof), mercapto group (or salt thereof), alkoxy group, aryloxy group, heterocyclic oxy group, alkylthio group, arylthio group, heterocyclic thio group, amino group and heterocyclic group.

Among the compounds expressed by the formula (N1), another more preferable example is a compound in which Z and $R^1$ bind with each other to form a non-aromatic five- to seven-membered ring structure; either $R^2$ or $R^3$ represents a hydrogen atom and the other represents any one of hydroxyl group (or salt thereof), mercapto group (or salt thereof), alkoxy group, aryloxy group, heterocyclic oxy group, alkylthio group, arylthio group, heterocyclic thio group, amino group and heterocyclic group.

The non-aromatic five- to seven-membered ring formed by Z and $R^1$ is specifically indane-1,3-dione ring; pyrrolidine-2,4-dione ring; pyrazolidine-3,5-dion ring; oxazolidine-2,4-dione ring; 5-pyrazolone ring; imidazolidine-2,4-dione ring; thiazolidine-2,4-dione ring; oxolane-2,4-dione ring; thiolane-2,4-dione ring; 1,3-dioxane-4,6-dione ring, cyclohexane-1,3-dione ring; 1,2,3,4-tetrahydroquinoline-2,4-dione ring, cyclopentane-1,3-dione ring; isooxazolidine-3,5-dione ring; barbituric acid ring; 2,3-dihydrobenzofuran-3-one ring; pyrazolotriazole ring (e.g. 7H-pyrazolo[1,5-b][1,2,4]triazole, 7H-pyrazolo[5,1-c][1,2,4]-triazole, 7H-pyrazolo[1,5-a]benzimidazole); pyrrolotriazole ring (e.g. 5H-pyrrolo[1,2-b][1,2,4]triazole, 5H-pyrrolo[2,1-c][1,2,4]-triazole; 2-cyclopentene-1,4-dione ring; 2,3-dihydrobenzo-thiophene-3-one-1,1-dioxide ring; chroman-2,4-dione ring; 2-oxazoline-5-one ring; 2-imidazoline-5-one ring; 2-thiazoline-5-one ring; 1-pyrroline-4-one ring, 5-oxothiazolidine-2-thione ring; 4-oxothiazolidine-2-thione ring; pyrrolopyrimidinone ring; 1,3-dithiolane ring; thiazolidine ring, 1,3-dithiethane ring or 1,3-dioxolane ring. Among these more preferable are indane-1,3-dione ring; pyrrolidine-2,4-dione ring; pyrazolidine-3,5-dion ring; 5-pyrazolone ring; barbituric acid ring; and 2-oxazoline-5-one ring.

The substituents expressed by $R^4$ in the formula (N2) can be exemplified as those described for $R^1$ to $R^3$ in the formula (N1).

The substituents expressed by $R^4$ in the formula (N2) is preferably an electron attracting group or aryl group. When $R^4$ represents an electron attracting group, a total carbon number of which is preferably 0 to 30, which can be exemplified as cyano group, nitro group, acyl group, formyl group, alkoxycarbonyl group, aryloxycarbonyl group, alkylsulfonyl group, arylsulfonyl group, carbamoyl group, sulfamoyl group, perfluoroalkyl group, phosphoryl group, imino group, sulfonamide group and heterocyclic group. Among these, more preferable are cyano group, acyl group, formyl group, alkoxycarbonyl group, carbamoyl group, sulfamoyl group, alkylsulfonyl group, arylsulfonyl group, sulfonamide group and heterocyclic group.

When $R^4$ represents an aryl group, it is preferably a substituted or unsubstituted phenyl group with a total carbon number of 0 to 30, the substituent of which can be exemplified as those described for $R^1$, $R^2$ and $R^3$ in the formula (N1) for the case that $R^1$, $R^2$ and $R^3$ represent the substituents. Among which, an electron attracting group is preferable.

The substituents expressed by X and Y in the formula (N3) can be exemplified as those described for $R^1$ to $R^3$. The substituents expressed by X and Y in the formula (N3) preferably have an total carbon number of 1 to 50, and more preferably 1 to 35, which are exemplified as cyano group, alkoxycarbonyl group, aryloxycarbonyl group, carbamoyl group, imino group, imino group substituted by nitrogen atom, thiocarbonyl group, sulfamoyl group, alkylsulfonyl group, arylsulfonyl group, nitro group, perfluoroalkyl group, acyl group, formyl group, phosphoryl group, acylamino group, acyloxy group, acylthio group, heterocyclic group, alkylthio group, alkoxy group and aryl group. Among these, more preferable are cyano group, nitro group, alkoxycarbonyl group, carbamoyl group, acyl group, formyl group, acylthio group, acylamino group, thiocarbonyl group, sulfamoyl group, alkylsulfonyl group, arylsulfonyl group, imino group, imino group substituted by nitrogen atom, phosphoryl group, trifluoromethyl group, heterocyclic group and substituted phenyl group. Still more preferable are cyano group, alkoxycarbonyl group, carbamoyl group, alkylsulfonyl group, arylsulfonyl group, acyl group, acylthio group, acylamino group, thiocarbonyl group, formyl group, imino group, imino group substituted by nitrogen atom, heterocyclic group and phenyl group substituted by arbitrary substituent.

It is also preferable that X and Y mutually bind to form a non-aromatic carbon ring or non-aromatic hetero ring. The ring thus formed is preferably of five- to seven-membered, and more specifically typified as that similar to non-aromatic five- to seven-membered ring formed by bonding between Z and $R^1$ in the formula (N1), preferable ranges of which being also the same. These rings may have an additional substituent to provide a total carbon number of 1 to 40, and more preferably 1 to 35.

The group represented by A or B in the formula (N3) may have an additional substituent to provide a total carbon number of 1 to 40, and more preferably 1 to 30.

A more preferable case relates to that A and B in the formula (N3) bind with each other to form a cyclic structure. The cyclic structure thus obtained is preferably a five- to seven-membered non-aromatic hetero ring with a total carbon number of 1 to 40, and more preferably 3 to 30. Examples of the bound structures between A and B (-A-B-) include, for example, —O—$(CH_2)_2$—O—, —O—$(CH_2)_3$—O—, —S—$(CH_2)_2$—S—, —S—$(CH_2)_3$—S—, —S-ph-S—, —N$(CH_3)$—$(CH_2)_2$—O—, —N$(CH_3)$—$(CH_2)_2$—S—, —O—$(CH_2)_2$—S—, —O—$(CH_2)_3$—S—, —N$(CH_3)$-ph-O—, —N$(CH_3)$-ph-S— and —N(ph)-$(CH_2)_2$—S—.

The compounds expressed by the formulae (N1) to (N3) used in the present invention may be incorporated with an adsorptive group capable of adsorbing silver halide, or with a ballast group or polymer commonly used in immobile photographic additives such as a coupler. The compound also may contain a cationic group (e.g. a group containing quaternary ammonio group, or nitrogen-containing hetero ring containing a quaternized nitrogen atom); a group containing repetitive units of ethyleneoxy group or propyleneoxy group; (alkyl, aryl or heterocyclic)thio group; or dissociative group capable of dissociating under the presence of base (e.g. carboxyl group, sulfo group, acylsulfamoyl group, carbamoylsulfamoyl group). Such groups are disclosed in, for example, JP-A-63-29751, U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, JP-A-63-234246, JP-A-2-285344, JP-A-1-100530, JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent No. 4,006,032.

Exceptionally useful compounds as an ultrahigh contrast agent used in the present invention are substituted alkene derivatives as expressed by the formula (N1). Among these, further preferable are those compound in which Z and $R^1$ in the formula (N1) bind with each other to form a non-aromatic five- to seven-membered ring structure; either $R^2$ or $R^3$ represents a hydrogen atom and the other represents a hydroxyl group (or salt thereof), mercapto group (or salt thereof), alkoxy group, aryloxy group, heterocyclic oxy group, alkylthio group, arylthio group, heterocyclic thio group, amino group or heterocyclic group.

Specific examples of the compounds expressed by the formulae (N1) to (N3) in the present invention are listed below, while not being limited thereto:

1

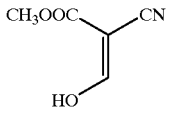

2

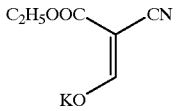

3

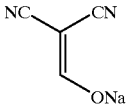

4

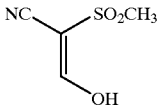

5

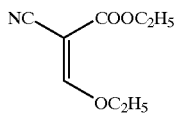

-continued
6
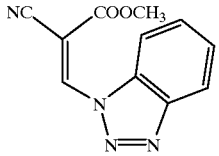
7
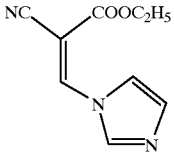
8
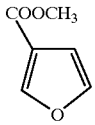
9
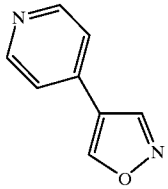
10
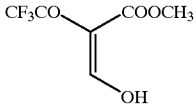
11
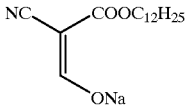
12
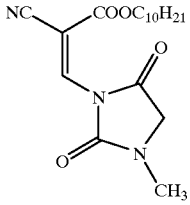
13
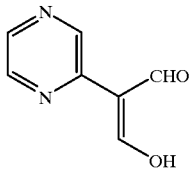
14
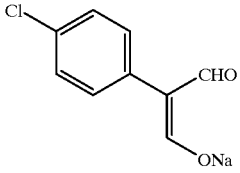
-continued
15
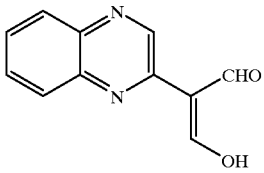
16
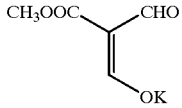
17
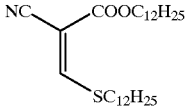
18
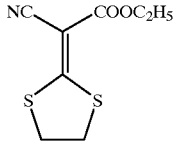
19
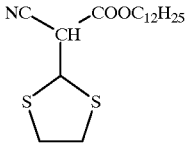
20
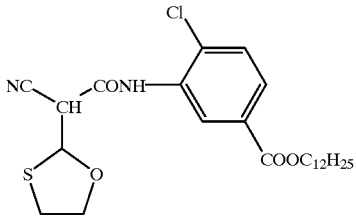
21
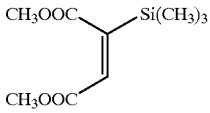
22
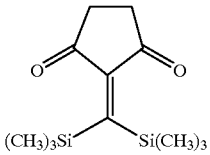
23
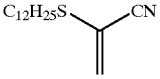
24
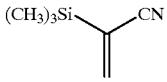

-continued
25
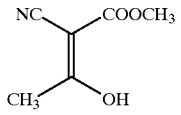
26
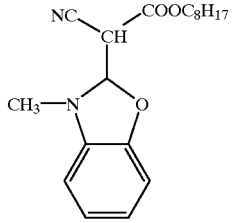
27
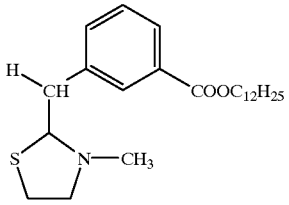
28
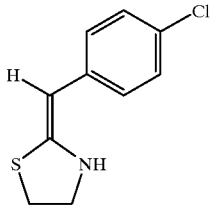
29
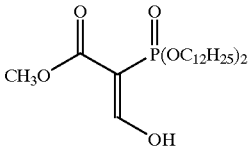
30
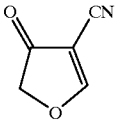
31
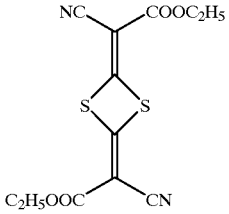
32
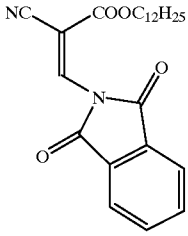
-continued
33
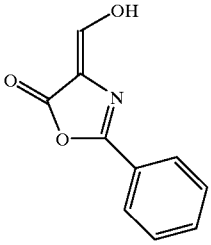
34
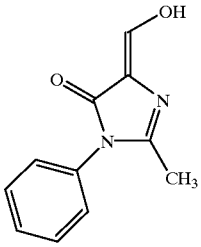
35
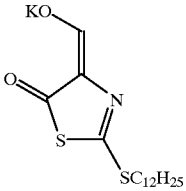
36
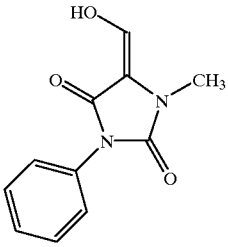
37
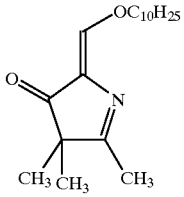
38
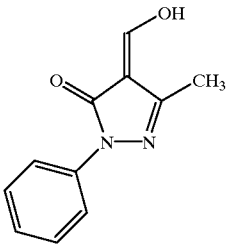

-continued
39
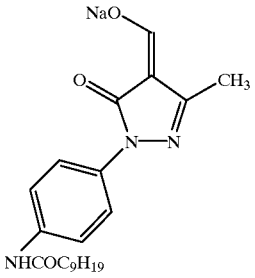
40
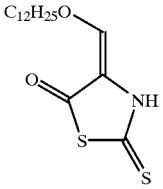
41
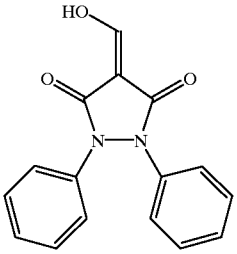
42
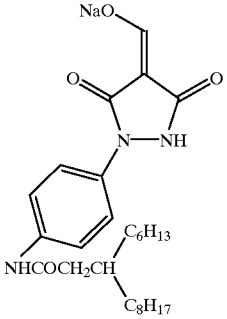
43
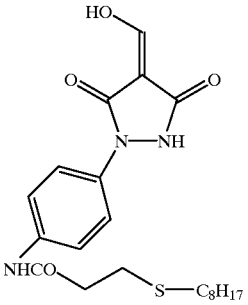
44
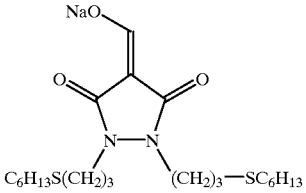
-continued
45
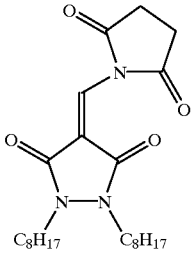
46
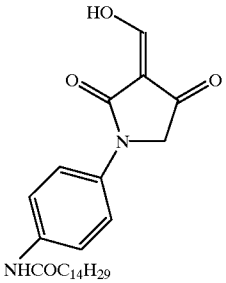
47
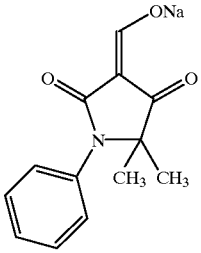
48
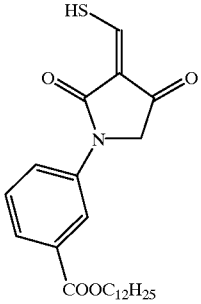
49
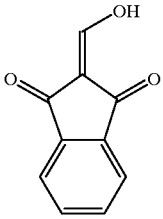
50
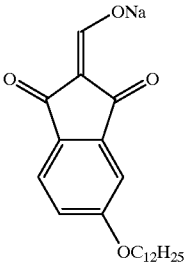

-continued
51
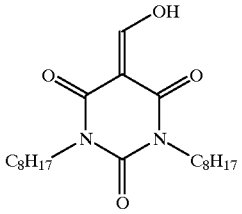
52
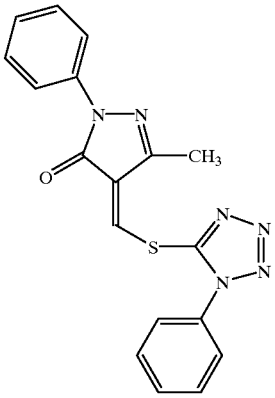
53
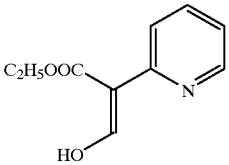
54
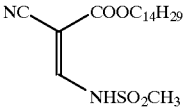
55
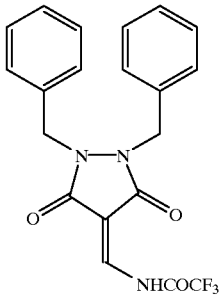
56
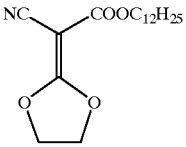
-continued
57
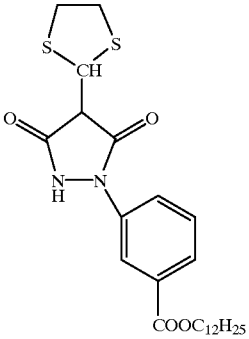
58
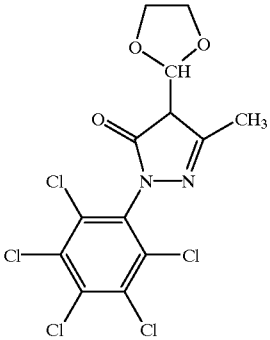
59
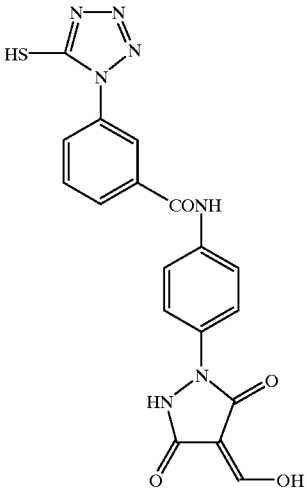
60
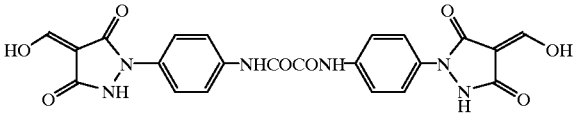
61
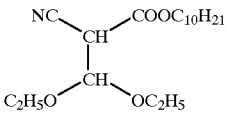

-continued

62

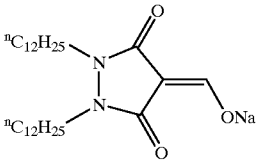

63

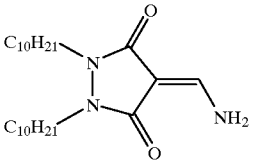

64

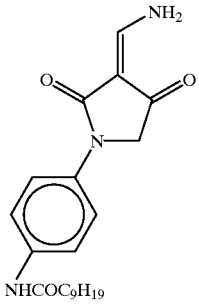

65

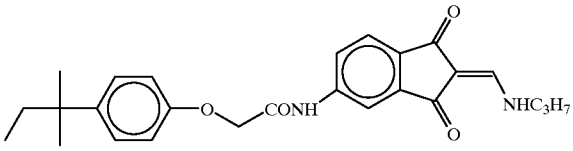

66

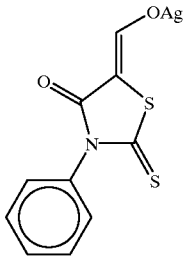

67

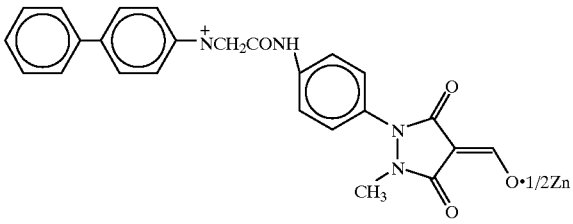

68

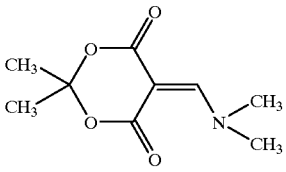

-continued

69

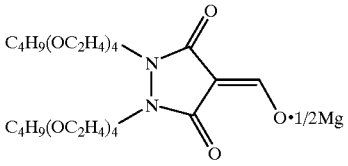

70

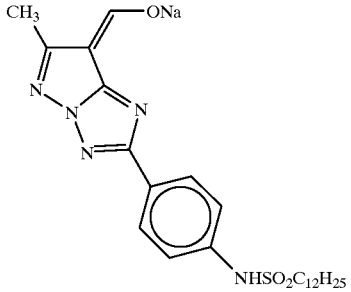

71

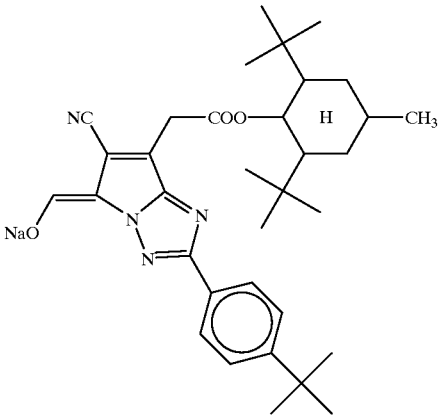

72

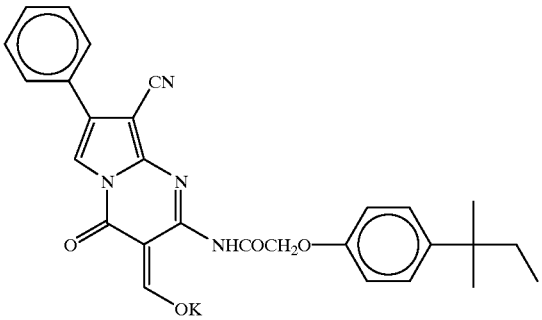

The compounds expressed by the general formulae (N1) to (N3) can easily be synthesized according to known methods referring, for example, to U.S. Pat. No. 5,545,515, No. 5,635,339, No. 5,654,130, International Patent Publication WO 97/34196 or JP-A-9-354107, JP-A-9-309813 and JP-A-9-272002.

The compounds represented by the general formulae (N1) to (N3) may be used individually or in combination of two or more thereof. In addition to these compounds, compounds described in U.S. Pat. No. 5,545,515, No. 5,635,339, No. 5,654,130, No. 5,705,324 and No. 5,686,228, JP-A-10-161270, JP-A-9-273935, JP-A-9-354107, JP-A-9-309813, JP-A-9-296174, JP-A-9-282564, JP-A-9-272002, JP-A-9-272003 and JP-A-9-332388 may also be used in combination.

In the present invention, various hydrazine derivatives disclosed in JP-A-10-161270 can also be used in combination.

The compounds expressed by the formulae (N1) to (N3) can be used in the present invention as dissolved in water or other appropriate organic solvents such as alcohols (methanol, ethanol, propanol, fluorinated alcohol), ketones (acetone, methyl ethyl ketone), dimethylformamide, dimethylsulfoxide and Methyl Cellosolve.

The compounds can also be used in a form of emulsified dispersion obtained mechanically be the well-known emulsifying dispersion method by which the compounds are dissolved in oil such as dibutyl phthalate, tricresyl phosphate, glyceryl triacetate and diethyl phthalate; or in auxiliary solvent such as ethyl acetate and cyclohexanone. Alternative method relates to the solid dispersion method by which powders of the hydrazine derivative are dispersed into water or other appropriate solvent with aid of a ball mill, colloid mill or ultrasonic wave.

The compounds of the general formulae (11) to (13) used in the present invention can be added to any layer provided on the side of the image-forming layer as viewed from a support, where addition to the image-forming layer or to the layer adjacent thereto is preferable.

In the present invention, the compounds of the general formulae (N1) to (N3) are preferably used in an amount, as expressed by a molar amount per 1 mol of silver, from $1\times10^{-6}$ to 1 mol, and more preferably from $1\times10^{-5}$ to $1\times10^{-1}$ mol, and still more preferably from $2\times10^{-5}$ to $2\times10^{-1}$ mol.

The image-forming layer in the present invention contains organic binder. As the organic binder, available are a variety of synthetic polymers previously known (for, example, cellulose derivatives such as cellulose acetate, cellulose acetate butylate, sodium salt of carboxylmethylcellulose and hydroxycellulose; and vinyl polymers such as polyvinylalcohol, polyvinyl acetate, polyvinyl butyral and polyvinyl formal); gelatin; agar; and polysaccharide. In the present invention, at least one layer of the image-forming layer is preferably such that containing water-dispersed thermoplastic resin at 50 wt % or more of the total binder. The water-dispersed thermoplastic resin can be used not only for the image-forming layer, but also for the protective layer and back layer, and can successfully be applied to printing where dimensional variation raises a critical issue.

The water-dispersed thermoplastic resin preferably used in the present invention can have any dispersion status such that the polymer is emulsified in the dispersion medium, emulsion-polymerized, dispersed as micells, or the polymer is dispersed so that its molecular chain per se disperses when the polymer has, in a part of its body, some hydrophilic structure. Such water-base dispersion is generally called polymer latex in a broad sense. Details of the polymer latex are described, for example, in "Gosei Jushi Emulsion (Synthetic Resin Emulsion)", ed. by Taira Okuda and Hiroshi Inagaki, issued by Kobunshi Kanko Kai (1978); "Gosei Latex no O-yo (Applications of Synthetic Latex)", ed. by Takaaki Sugimura, Yasuo Katacka, Souichi Suzuki and Keiji Kasahara, issued by Kobunshi Kanko Kai (1993); and "Gosei Latex no Kagaku (Chemistry of Synthetic Latex)", by Soichi Muroi, issued by Kobunshi Kanko Kai (1970). The dispersed particles preferably have an average particle size of 1 to 50,000 nm, more preferably approx. 5 to 1,000 nm. The particle size distribution of the dispersed particles is not particularly limited, and the dispersed particles may have a broad particle size distribution or a monodisperse particle size distribution.

As the polymer latex for use in the present invention, not only an ordinary uniform-structured polymer latex but also a so-called core/shell type latex is available. In some cases, it may be preferred that the core and the shell have different glass transition temperatures.

Preferable range of the glass transition temperature (Tg) of the polymer latex used as the binder in the present invention differ according to tis use for the protective layer, back layer or image-forming layer. For use in the image-forming layer, the glass transition temperature is preferably 40° C. or lower, and more preferably from −30 to 40° C., so that the photographically useful material can acceleratingly disperse at the time of heat development. For use in the protective layer and back layer, a glass transition temperature of 25 to 70° C. is preferable since the layers come into contact with various kinds of equipment.

The polymer latex for use in the present invention preferably has a minimum film-forming temperature (MFT) of from −30 to 90° C. more preferably from 0 to 70° C. In order to control the MFT, a film-forming aid may be added. The film-forming aid, also called a temporary plasticizer, refers to an organic compound (usually an organic solvent) capable of lowering the MFT of the polymer latex, which is described, for example, in "Gosei Latex no Kagaku (Chemistry of Synthetic Latex)", by Souichi Muroi, issued by Kobunshi Kanko Kai (1970), supra.

The polymer species of the polymer latex for use in the present invention include acrylic resin, vinyl acetate resin, polyester resin, polyurethane resin, rubber-based resin, vinyl chloride resin, vinylidene chloride resin, polyolefin resin or copolymers thereof. The polymer may be a straight-chained polymer, a branched polymer or a cross-linked polymer. The polymer may be a so-called homopolymer consisting of a single kind of monomer or may be a copolymer consisting of two or more kinds of monomers. Both of random copolymer and block copolymer are allowable as the copolymer. The polymer preferably has a number average molecular weight of from 5,000 to 1,000,000, and more preferably from 10,000 to 100,000. Too small molecular weight will result in poor mechanical strength of the image-forming layer, whereas too large in degraded and undesirable film-forming property.

Specific examples of the water-dispersed thermoplastic resin (polymer latex) used for the present invention include methyl methacrylate/ethyl acrylate/methacrylic acid copolymer latex, methyl methacrylate/2-ethylhexyl acrylate/styrene/acrylic acid copolymer latex, styrene/butadiene/acrylic acid copolymer latex, styrene/butadiene/divinylbenzene/methacrylic acid copolymer latex, methyl methacrylate/vinyl chloride/acrylic acid copolymer latex, and vinylidene chloride/ethyl acrylate/acrylonitrile/methacrylic acid copolymer latex. Such polymers are also commercially available, which include acrylic resins such as CEBIAN A-4635, 46583 and 4601 (all produced by Dicel Kagaku Kogyo KK) and Nipol Lx811, 814, 821, 820, 857 (all produced by Nippon Zeon KK); polyester resins such as FINETEX ES 650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dei-Nippon Ink & Chemicals, Inc.); rubber-based resins such as LACSTAR 7310K, 3307B, 4700H, 7132C (all produced by Dai-Nippon Ink & Chemicals, Inc.), Nipol Lx416, 410, 438C and 2507 (all produced by Nippon Zeon KK); vinyl chloride resins such as G351, G576 (both produced by Nippon Zeon KK); vinylidene chloride resins such as L502, L513 (both produced by Asahi Chemical Industry Co., Ltd.), ARON D7020, D504 and D5071 (all produced by Mitsui Chemical Co., Ltd.); and olefin resins such as CHEMIPEARL S120 and SA100 (both produced by Mitsui Chemical Co., Ltd.). These polymers may be used individually or, as required, as a blend of two or more thereof.

In the present invention, the image-forming layer can be added with, as required, hydrophilic polymer such as gelatin, polyvinyl alcohol, methylcellulose, hydroxypropylcellulose, carboxymethylcellulose and hydroxypropylmethylcellulose in an amount of 50 wt % or less of the total binder, and preferably 10 wt % or less.

It is preferable that the image-forming layer is formed by coating water-base liquid, which is followed by drying. Here, "water-base" in the context of the present invention refers to that water accounts for 60 wt % or more of the solvent (dispersion medium) of the coating liquid. Possible component of the coating liquid other than water may be water-miscible organic solvent such as methanol, ethanol, isopropanol, Methyl Cellosolve, Ethyl Cellosolve, dimethylformaide and ethyl acetate. Specific examples of the solvent composition include water/methanol=90/10, water/methanol=70/30, water/ethanol=90/10, water/isopropanol=90/10, water/dimethylformamide=95/5, water/methanol/dimethylformamide=80/15/5 and water/methanol/dimethylformamide=90/5/5 (the numerals are in wt %).

Amount of the total binder of the image-forming layer is preferably 0.2 to 30 g/m$^2$, and more preferably 1 to 15 g/m$^2$. The image-forming layer may be added with a cross-linking agent for crosslinking or a surfactant for improving coating property.

In the present invention, the image-forming layer or other layers adjacent thereto preferably contain phthalic acid derivatives such as phthalic acid, 4-methylphthalic acid, tetrachlorophthalic acid, tetrafluorophthalic acid, 3-methylphthalic acid, 3,5-dimethylphthalic acid, 4,5-dichlorophthalic acid, 3-phenylphthalic acid and 3-nitrophthalic acid.

The phthalic acid derivatives can be added, on the same side with the image-forming layer of the heat-developable image recording material, to photosensitive layers such as the image-forming layer and also to non-photosensitive layers such as the protective layer.

The amount of addition of the phthalic acid derivatives expressed in mol per one mole of silver is preferably $10^{-4}$ to 1 mol, more preferably $10^{-3}$ to 0.3 mol, and still more preferably $10^{-3}$ to 0.1 mol. The phthalic acids can be used individually or in combination of two or more thereof.

The phthalic acid derivatives may be added in any form of solution, powder or solid microparticle dispersion. Dispersion of the solid microparticle is effected using a known pulverizing means (e.g. ball mill, vibrating ball mill, sand mill, colloid mill, jet mill and roller mill). A dispersion aid may be available for dispersing the solid microparticle.

The silver halide emulsion and/or organic silver salt for use in the present invention can successfully be prevented, by addition of antifoggant, stabilizer or stabilizer precursor, from additional fogging and from lowered sensitivity during the stock storage. Appropriate examples of antifoggants, stabilizers and stabilizer precursors, available individually or in combination, include thiazonium salts described in U.S. Pat. Nos. 2,131,038 and 2,694,716; azaindenes described in U.S. Pat. Nos. 2,886,437 and 2,444,605; mercury salts described in U.S. Pat. No. 2,728,663; urazoles described in U.S. Pat. No. 3,287,135; sulfocatechol described in U.S. Pat. No. 3,235,652; oximes, nitrons and nitroindazoles described in British Patent No. 623,448; polyvalent metal salts described in U.S. Pat. No. 2,839,405; thiuronium salts described in U.S. Pat. No. 3,220,839; palladium, platinum and gold salts described in U.S. Pat. Nos. 2,566,263 and 2,597,915; halogen-substituted organic compounds described in U.S. Pat. Nos. 4,108,665 and 4,442,202; triazines described in U.S. Pat. Nos. 4,128,557, 4,137,079, 4,138,365 and U.S. Pat. No. 4,459,350; and phosphorus compounds described in U.S. Pat. No. 4,411,985.

The antifoggant which is preferably used in the present invention is organic halide, and the typical compounds are disclosed in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809 and U.S. Pat. Nos. 5,340,712, 5,369,000 and U.S. Pat. No. 5,464,737.

The antifoggant used in the present invention may be added in any form of solution, powder or solid microparticle dispersion. Dispersion of the solid microparticle is effected using a known pulverizing means (e.g. ball mill, vibrating ball mill, sand mill, colloid mill, jet mill and roller mill). A dispersion aid may be available for dispersing the solid microparticle.

While not being essential for implementing the present invention, it is advantageous in some cases to add a mercury (II) salt as an antifoggant to the emulsion layer. Preferred mercury(II) salts for this purpose are mercury acetate and mercury bromide. The amount of addition of mercury for use in the present invention is preferably from $10^{-9}$ to $10^{-3}$ mol per one mol of silver coated, and more preferably from $10^{-8}$ to $10^{-4}$ mol.

The heat-developable image recording material of the present invention may contain a benzoic acids for improving the sensitivity and for preventing fog. Any kind of benzoic acid derivatives are available for the present invention, where preferred examples of the structure include those described in U.S. Pat. Nos. 4,784,939 and 4,152,160 and JP-A-8-151242, JP-A-8-151241 and JP-A-8-98051. Although the benzoic acids for use in the present invention may be added to any portion of the recording material, addition to a layer provided on the same side with the photosensitive layer is preferable, and to an organic-silver-salt-containing layer is more preferable. The benzoic acids may be added at any step during the preparation of the coating liquid. In the case of addition to the organic-silver-salt-containing layer, the benzoic acids may be added at any step within a period from the preparation of the organic silver salt to the preparation of the coating liquid, where addition in a period following the preparation of the organic silver salt and immediately before the coating is preferable. The benzoic acids may be added in any form of solution, powder or solid microparticle dispersion. It is also allowable to add the benzoic acids in a form of mixed solution containing other additives such as a sensitizing dye, reducing agent and color toner. The amount of addition of the benzoic acids can arbitrarily set, where a preferable range being from $10^{-6}$ to 2 mol, inclusive, per one mole of silver, and more preferably from $10^{-3}$ to 0.5 mol, inclusive.

The heat-developable image recording material of the present invention may contain mercapto compound, disulfide compound or thione compound so as to control the development by inhibiting or accelerating thereof, to improve the spectral sensitization efficiency, or to improve the storage stability before and after the development.

While any structure of mercapto compound may be available in the present invention, such that expressed by Ar—SM or Ar—S—S—Ar is preferable, wherein M represents a hydrogen atom or alkali metal atom; and Ar represents an aromatic ring or condensed aromatic ring containing one or more nitrogen, sulfur, oxygen, selenium or tellurium atoms. Preferable heteroaromatic rings include benzimidazole, naphthimidazole, benzothiazole, naphthothiazole, benzoxazole, naphthoxazole, benzoselenazole, benzotellurazole, carbazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of halogen (e.g. Br, Cl), hydroxyl, amino, carboxyl, alkyl (e.g. alkyl having one or more carbon atoms, preferably from 1 to 4 carbon atoms), alkoxy (e.g. alkoxy having one or more carbon atoms, preferably from 1 to 4 carbon atoms) and aryl (which may also be substituted). Examples of the mercapto- substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-thiazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)benzenesulfonate, N-methyl-N'-[3-(5-mercaptotetrazolyl)phenyl]urea, 2-mercapto-4-phenyloxazole, and N-[3-(mercaptoacetylamino)propyl] carbazole, while not particularly being limited thereto.

The amount of the addition, into the emulsion layer, of the mercapto compounds is preferably from 0.0001 to 1.0 mol per one mol of silver, more preferably from 0.001 to 0.3 mol.

Next, the photosensitive silver halide used in the present invention will be detailed.

The photosensitive silver halide used in the present invention has no limitation with regard to its halogen composition, and any of silver chloride, silver chlorobromide, silver bromide, silver iodobromide and silver iodochlorobromide is available. The halogen composition distribution within the grain may be uniform, or the halogen composition may be changed stepwise or continuously. Silver halide grain with a core/shell structure may preferably be used, in which the structure is preferably of two- or five-fold, and more preferably of two- to four-fold. It is also preferable to adopt a technique for localizing silver bromide on the surface of silver chloride or silver cholorobromide.

Methods for producing photosensitive silver halide used in the present invention are well known in the art, and, for example, the methods described in *Research Disclosure*, No. 17029 (June, 1978) and U.S. Pat. No. 3,700,458 may be applied. The method applicable to the present invention include such that adding a halogen-containing compound to the prepared organic silver salt to convert a part of silver contained therein into photosensitive silver halide, and such that adding a silver-supplying compound and a halogen-supplying compound to gelatin or other polymer solution to thereby prepare photosensitive silver halide grain which is then mixed with an organic silver salt, where the latter method is more preferable. The photosensitive silver halide grain preferably has a small grain size so as to prevent high white turbidity after image production. Specifically, the grain size is preferably 0.20 $\mu$m or less, more preferably from 0.01 to 0.15 $\mu$m, still more preferably from 0.02 to 0.12 $\mu$m. The term "grain size" as used herein means the length of an edge of the silver halide grain for the case that the grain is a normal crystal having cubic or octahedral shape; and means the diameter of a circle image having an area equal to the projected area of the major plane of the silver halide grain for the case that the grain is tabular; and means the diameter of a sphere having a volume equal to that of the silver halide grain for the case that the grain has other irregular shape such as sphere or rod.

Examples of the shape of the silver halide grain include cubic, octahedral, tabular, spherical, rod and pebble; among these, cubic and tabular shapes being preferred in the present invention. When a tabular silver halide grain is used, the average aspect ratio is preferably from 100:1 to 2:1, more preferably from 50:1 to 3:1. A silver halide grain having rounded corners is also preferably used. The plane indices (Miller indices) of the outer surface plane of a photosensitive silver halide grain is not particularly limited; however, it is preferred that [100] plane showing a high spectral sensitization efficiency upon adsorption of the spectral sensitizing dye occupies a large percentage. The percentage is preferably 50% or above, more preferably 65% or above, still more preferably 80% or above. The percentage of a plane with a Miller index of [100] can be determined by the method described in T. Tani, *J. Imaging Sci.*, 29, 165 (1985), which is based on the plane dependency of adsorption of the sensitizing dye between [111] and [100] planes.

The photosensitive silver halide grain for use in the present invention preferably contains a Group VII metal or Group VIII metal in the Periodic Table, or metal complex. The Group VII metal or Group VIII metal in the Periodic Table, or a center metal of the metal complex is preferably rhondium, rhenium, ruthenium, osmium or iridium. These metal complexes may be used individually, or in combination of two or more complexes of the same metal or different metals. The metal complex content is preferably from $1\times10^{-9}$ to $1\times10^{-2}$ mol per one mol of silver, and more preferably from $1\times10^{-8}$ to $1\times10^{-4}$ mol. With respect to the specific structure of the metal complexes, those having the structures described in JP-A-7-225449 may be used.

As the rhodium compound preferably used in the present invention relates to a water-soluble rhodium compound. Examples thereof include a rhodium(III) halide compounds; and rhodium complex salts having a halogen, amines or an oxalates as ligands, such as hexachlororhodium(III) complex salt, pentachloroaquorhodium(III) complex salt, tetrachlorodiquorhodium(III) complex salt, hexabromorhodium(III) complex salt, hexaamminerhodium (III) complex salt and trioxalatorhodium(III) complex salt. These rhodium compounds are used in a dissolved form in water or other appropriate solvent, where a method commonly used for stabilizing the rhodium compound solution may be applied, in which an aqueous hydrogen halide solution (e.g. hydrochloric acid, bromic acid, fluoric acid) or alkali halide (e.g. KCl, NaCl, DBr, NaBr) is added. In place of using the water-soluble rhodium, separate silver halide grains predoped with rhodium may be added and dissolved at the time of preparation of silver halide.

The amount of the rhodium compound added is preferably from $1\times10^{-8}$ to $5\times10^{-6}$ mol per one mole of silver halide, and more preferably from $5\times10^{-8}$ to $1\times10^{-6}$ mol.

The rhodium compound may appropriately be added at the time of production of silver halide emulsion grains or at respective stages before coating of the emulsion, where more preferable is to add the compound at the time of emulsion production to be incorporated into the silver halide grain.

Rhenium, ruthenium or osmium for use in the present invention is added in the form of water-soluble complex salt described in JP-A-63-2042, JP-A-1-285941, JP-A-2-20852 and JP-A-2-20855, exceptionally preferred example thereof refers to a hexacoordination complex salt represented by the following formula:

$$[ML_6]^{n-}$$

wherein M represents Ru, Re or Os; and n represents 0, 1, 2, 3 or 4.

In this case, ammonium or alkali metal ion is used as courterion, while the ion being of no importance.

Preferred examples of the ligand include halide ligand, cyan ligand, cyanoxide ligand, nitrosyl ligand and thionitrosyl ligand Specific examples of the complex for use in the present invention shown below, while not being limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{2-}$ | $[RuCl_5(H_2O)]^{2-}$ |
| $[RuCl_5(NO)]^{2-}$ | $[RuBr_5(NS)]^{2-}$ | |
| $[Ru(CO)_3Cl_3]^{2-}$ | $[Ru(CO)Cl_5]^{2-}$ | $[Ru(CO)Br_5]^{2-}$ |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(O)_2(CN)_4]^{4-}$ | |

The amount of addition of these compounds is preferably in $1\times10^{-9}$ to $1\times10^{-5}$ mol per one mole of silver halide, and more preferably from $1\times10^{-8}$ to $1\times10^{-6}$ mol.

These compounds may be added appropriately at the time preparation of silver halide emulsion grains or at respective starting before coating of the emulsion where more preferable is to add the compound at the time of emulsion production to be incorporated in the silver halide grain.

As for adding the compound during the grain formation of silver halide and integrating it into a silver halide grain, application methods include such that previously adding an aqueous solution metal complex powder together with or without NaCl or KCl to a solution of water-soluble salt or water-soluble halide during the grain formation; such that adding the compound as the third solution at the time of simultaneously mixing a silver salt and a halide solution prepare silver halide grains by the triple jet method; and such that pouring a necessary amount of an aqueous metal complex solution in a reaction vessel during the grain formation. Among these, preferably is a method comprising adding an aqueous solution of metal compound powder together with or without NaCl or KCl to a water-soluble halide solution.

In order to add the compound to the grain surface, a necessary amount of an aqueous metal complex solution may be charged into a reaction vessel immediately after the grain formation, during or after completion of the physical ripening, or at the time of chemical ripening.

As the iridium compound for use in the present invention, various compounds may be used, and examples thereof include hexachloroiridium, hexammineiridium, trioxalatoridium, hexacyanoiridium and pentachloronitrosyliridium. These iridium compounds are used in a dissolved form in water or other appropriate solvent, where a method commonly used for stabilizing the iridium compound solution may be applied, in which an aqueous hydrogen halide solution (e.g. hydrochloric acid, bromic acid, fluoric acid) or alkali halide (e.g. KCl, NaCl, KBr, NaBr) is added. In place of using the water-soluble iridium, separate silver halide grains predoped with iridium may be added and dissolved at the time of preparation of silver halide.

The silver halide grain for use in the present invention may further contain a metal atom such as cobalt, iron, nickel, chromium, palladium, platinum, gold, thallium, copper and lead. As for cobalt, iron, chromium and ruthenium compound, hexacyano metal complex is preferably used. Specific examples thereof include ferricyanate ion, ferrocyanate ion, hexacyanocobaltate ion, hexacyanochromate ion and hexacyanoruthenate ion, while not being limited thereto. The phase of the silver halide, in which the metal complex is contained, is not particularly limited, and the phase may be uniform or the metal complex may be contained in a higher concentration in the core portion or in the shell portion.

The above-described metal is used preferably in an amount of from $1\times10^{-9}$ to $1\times10^{-4}$ mol per one mole of silver halide. The metal may be added at the time of preparation of the grains through converting it into a metal salt in the form of simple salt, double salt or complex salt.

The photosensitive silver halide grain may be desalted by water washing according to a method known in the art, such as noodle washing and flocculation, but the grain may not be desalted in the present invention.

The silver halide emulsion for use in the present invention is preferably subjected to chemical sensitization. The chemical sensitization may be performed using a known method such as sulfur sensitization, selenium sensitization, tellurium sensitization or noble metal sensitization. These sensitization method may be used alone or in any combination. When these sensitization methods are used in combination, preferable combinations include sulfur and gold sensitizations; sulfur, selenium and gold sensitizations; sulfur, tellurium and gold sensitizations; and sulfur, selenium, tellurium and gold sensitizations.

The sulfur sensitization applied to the present invention is usually performed by adding a sulfur sensitizer and stirring the emulsion at a temperature as high as 40° C. or above for a predetermined time. The sulfur sensitizer may be a known compound and examples thereof include, in addition to the sulfur compound contained in gelatin, various sulfur compounds such as thiosulfates, thioureas, thiazoles and rhodanines, among which thiosulfate and thiourea being preferable. Although the amount of the sulfur sensitizer to be added varies depending upon various conditions such as pH, temperature and grain size of silver halide at the time of chemical ripening, it is preferably from $10^{-7}$ to $10^{-2}$ mol per one mol of silver halide, and more preferably from $10^{-5}$ to $10^{-3}$ mol.

The selenium sensitizer for use in the present invention may be a known selenium compound. The selenium sensitization is usually performed by adding a labile and/or non-labile selenium compound and stirring the emulsion at a temperature as high as 40° C. or above for a predetermined time. Examples of the labile selenium compound include those described in JP-B-44-15748, JP-B-43-13489, JP-A-4-25832, JP-A-4-109240 and JP-A-4-324855. Among these, particularly preferred are those expressed by formulae (VIII) and (IX) of JP-A-4-324855.

The tellurium sensitizer for use in the present invention is a compound capable of producing silver telluride, presumably serve as a sensitization nucleus, on the surface or inside of silver halide grain. The rate of the formation of silver telluride in a silver halide emulsion can be examined according to a method described in JP-A-5-313284. Examples of the tellurium sensitizer include diacyl tellurides, bis (oxycarbonyl) tellurides, bis(carbamoyl) tellurides, diacyl ditellurides, bis(oxycarbonyl) ditellurides, bis(carbamoyl) ditellurides, compounds having a P═Te bond, tellurocarboxylates, Te-organyltellurocarboxylic esters, di(poly)tellurides, tellurides, tellurols, telluroacetals, tellurosulfonates, compounds having a P—Te bond, Te-containing heterocycles, tellurocarbonyl compounds, inorganic tellurium compounds and colloidal tellurium. Specific examples thereof include the compounds described in U.S. Pat. Nos. 1,623,499, 3,320,069 and U.S. Pat. No. 3,772,031; British Patents No. 235,211, No. 1,121,496, No. 1,295,462 and No. 1,396,696; Canadian Patent No. 800,958; JP-A-4-204640, JP-A-3-53693, JP-A-3-131598, JP-A-4-129787; *J. Chem. Soc. Chem. Commun.,* 635 (1980), ibid., 1102 (1979); ibid., 645 (1979); *J. Chem. Soc. Perkin. Trans.,* 1, 2191 (1980); S. Patal (compiler), *The Chemistry of Organic Selenium and Tellurium Compounds*, Vol. 1 (1986); and ibid., Vol. 2 (1987). The compounds expressed by formulae (II), (III) and (IV) of JP-A-5-313284 are particularly preferred.

The amount of the selenium or tellurium sensitizer used in the present invention varies depending on silver halide grains used or chemical ripening conditions. However, it is generally from $10^{-8}$ to $10^{-2}$ mol per one mol of silver halide, preferably on the order of from $10^{-7}$ to $10^{-3}$ mol. The conditions for chemical sensitization in the present invention are not particularly restricted. However, in general, pH is from 5 to 8; pAg is from 6 to 11, preferably from 7 to 10; and temperature is from 40 to 95° C., preferably from 45 to 85° C.

Noble metal sensitizers for use in the present invention include gold, platinum, palladium and iridium, and particularly, gold sensitization is preferred. Examples of the gold sensitizers used in the present invention include chloroauric acid, potassium chloroaurate, potassium aurithiocyanate and gold sulfide, which can be used in an amount of approx. $10^{-7}$ to $10^{-2}$ mol per one mol of silver halide.

As for the silver halide emulsion for use in the present invention, production or physical ripening process for the silver halide grain may be performed under the presence of cadmium salt, sulfite, lead salt or thallium salt.

In the present invention, reductive sensitization may be adoptable. Specific examples of the compound used in the reductive sensitization include ascorbic acid, thiourea dioxide, stannous chloride, minoiminomethanesulfinic acid, hydrazine derivative, borane compound, silane compound and polyamine compound. The reductive sensitization may be performed by ripening the grains while keeping the emulsion at pH 7 or above, or at pAg 8.3 or below. Also, the reductive sensitization may be performed by introducing a single addition portion of silver ion during the formation of the grains.

To the silver halide emulsion for use in the present invention, thiosulfonic acid compound may be added by the method described in European Patent No. 293917A.

In the recording material used for the present invention, a single kind of silver halide emulsion may be used, or two or more kinds of silver halide emulsions (for example, those differ in the average grain size, halogen composition, crystal habit or chemical sensitization conditions) may be used in combination.

The amount of the photosensitive silver halide used in the present invention is preferably from 0.01 to 0.5 mol per one mole of the organic silver salt, more preferably from 0.02 to 0.3 mol, still more preferably from 0.03 to 0.25 mol. Methods for mixing photosensitive silver halide and organic silver salt separately prepared include such that mixing, after completion of the individual preparation, the silver halide grains and the organic silver salt in a high-speed stirrer, ball mill, sand mill, colloid mill, vibrating mill, homogenizer or the like; and such that mixing, at any timing during preparation of the organic silver salt, already-finished photosensitive silver halide to prepare the organic silver salt; while not being limited thereto as far as sufficient effects of the present invention are obtained.

The organic silver salt used in the present invention is relatively stable against light exposure but can produce silver image when heated at 80° C. or higher in the presence of light-exposed photocatalyst (e.g. latent image of photosensitive silver halide) and reducing agent. The organic silver salt may be any organic substance containing a source capable of reducing the silver ion. Silver salt of organic acid, in particular, silver salt of long-chained aliphatic carboxylic acid (with a carbon number of 10 to 30, and preferably 15 to 28) is preferred. Complex of organic or inorganic silver salt, whose ligand has a complex stability constant of from 4.0 to 10.0, is also preferred. The silver-supplying substance may preferably account for approx. 5 to 70 wt % of the image-forming layer. Preferable organic silver salt includes silver salt of organic compound having carboxyl group. Examples thereof include silver salts of aliphatic carboxylic acid and aromatic carboxylic acid, while not being limited thereto. Preferred examples of the silver salt of the aliphatic carboxylic acid include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate and mixtures thereof.

Silver salts of compounds have mercapto or thione group and derivatives thereof may also be used as the organic silver salt. Preferred examples of these compounds include silver salt of 3-mercapto-4-phenyl-1,2,4-triazole; silver salt of 2-mercaptobenzimidazole; silver salt of 2-mercapto-5-aminothiadiazole; silver salt of 2-(ethylglycolamido) benzothiazole; silver salts of thioglycolic acids such as silver salt of S-alkylthioglycolic acids (alkyl group of which having a carbon number of 12 to 22); silver salts of dithiocarboxylic acids such as silver salt of dithioacetic acid; silver salt of thioamides; silver salt of 5-carboxy-1-methyl-2-phenyl-4-thiopyridine; silver salt of mercaptotriazines; silver salt of 2-mercaptoenzoxazole; silver salts of 1,2,4,-mercaptothiazole derivatives such as silver salt of 3-amino-5-benzylthio-1,2,4-thiazole as described in U.S. Pat. No. 4,123,274; and silver salts of thione compounds such as silver salt of 3-(3-carboxyethyl)-4-methyl-4-thiazoline-2-thione as described in U.S. Pat. No. 3,301,678. Compounds containing imino group may also be used. Preferred examples of these compounds include silver salt of benzotriazole and derivatives thereof, for example, silver salt of benzotriazoles such as silver methylbenzotriazole; silver salts of halogenated benzotriazoles such as silver 5-chlorobenzotriazole; silver salts of 1,2,4-triazole and 1H-tetrazole, and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The shape of the organic silver salt which can be used in the present invention is not particularly limited but an acicular crystal form having a short and long axes is preferred. In the present invention, the short axis is preferably from 0.01 to 0.20 μm, more preferably from 0.01 to 0.15 μm, and the long axis is preferably from 0.10 to 5.0 μm, more preferably from 0.10 to 4.0 μm. The grain size distribution of the organic silver salt is preferably monodisperse. The term "monodisperse" as used herein means that the percentage of the value obtained by dividing the standard deviation of the length of the short axis or long axis by the length of the short axis or long axis, respectively, is preferably 100% or less, more preferably 80% or less, still more preferably 50% or less. The shape of the organic silver salt can be determined based on the image of organic silver salt dispersion observed with a transmission type electron microscope. Another method for determining the monodispersibility is such that obtaining the standard deviation of volume weighted mean diameter of the organic silver salt. The percentage (coefficient of variation) of the value obtained by dividing the standard deviation by the volume weighted mean diameter is preferably 100% or less, more preferably 80% or less, still more preferably 50% or less. The measurement procedures include irradiating laser light to the organic silver salt dispersed in a solution; deriving an autocorrelation function with respect to the time-dependent fluctuation in the scattered light; and thereby obtaining grain size (volume weighted means diameter).

The organic silver salt used in the present invention is preferably desalted. The desalting method is not particularly limited and a known method may be used. Known filtration methods such as centrifugal filtration, suction filtration, ultrafiltration and flocculation washing based on coagulation may be preferably used.

To obtain a solid dispersion of the organic silver salt with high S/N ratio, small grain size and no coagulation, it is preferable in the present invention to employ a dispersion method in which water-base dispersion, containing the organic silver salt as an image-forming medium and containing substantially no photosensitive silver salt, is converted into a high-speed flow, and pressure of which is then allowed to drop.

After such process, the water-base dispersion is mixed with aqueous photosensitive silver salt solution to produce a coating liquid of photosensitive image-forming medium. Using such coating liquid ensures a heat-developable image recording material with a low haze, low fog and high sensitivity. On the other hand, presence of the photosensitive silver salt at the time of dispersion through the conversion into high-pressure, high-speed flow tends to result in increased fog and significantly lowered sensitivity. Using organic solvent, in place of water, also tends to raise the haze, increase the fog and lower the sensitivity. In place of mixing the aqueous solution of the photosensitive silver salt, employing the conversion method, in which a part of the organic silver salt in the dispersion is converted into photosensitive silver salt, may lower the sensitivity.

The water-base dispersion dispersed after converted into the high-pressure, high-speed flow contains substantially no photosensitive silver salt, and content of which is made 0.1 mol % or less with respect to the non-photosensitive organic silver salt, and is not subjected to intentional addition of photosensitive silver salt.

Solid dispersion apparatuses and technologies for implementing the above dispersion method are detailed, for example, in "Bunsankei Rheology to Bunsanka Gijutu (Dispersed System Rheology and Dispersion Technology)", by Toshio Kajiuchi and Hiroki Usui, 1991, issued by Sinzansha Shuppan, p.357–403; and "Kagaku Kogaku no Sinpo (Advances in Chemical Engineering) Vol.24", ed. Tokai Section, The Society of chemical Engineers, 1990, issued by Maki Shoten, p.184–185. According to the dispersion method employed in the present invention, the water-based dispersion containing at least organic silver salt is fed to a piping while being pressurized with a high-pressure pump, then allowed to pass through a narrow slit, which causes an abrupt pressure drop to the water-base dispersion and thereby enables fine dispersion.

As for a high-pressure homogenizer available in the present invention, dispersion into fine particles is generally considered to be effected by dispersion force such as (a) "shearing force" generated when dispersoid passes through a narrow gap under high pressure and at high speed, and (b) "cavitation force" generated when the high pressure exerted on the dispersoid is released to the normal pressure. Galling homogenizer has long been known as such kind of dispersion apparatus, in which pressure-fed process solution to be dispersed is converted into a high-speed flow at a narrow gap on a cylinder surface, then rushed to be collided with the peripheral wall, thereby allowing emulsification or dispersion assisted by the impact force. Operating pressure is, in general, selected in a range from 100 to 600 kg/cm$^2$, and flow rate in several to 30 m/second. There is also proposed an apparatus such that having a sawtoothed high flow rate portion to increase the number of collision for a higher dispersion efficiency. In recent years, there has also been developed apparatuses allowing dispersion at higher pressure and after flow rate, which are typified as Microfluidizer (Microfluidex International Corporation) and Nanomizer (Tokushu Kika Kogyo Co., Ltd.).

Dispersion apparatuses appropriate to the present invention include Microfluidizer M-110S-EH (with G10Z interaction chamber), M-110Y (with H10Z interaction chamber), M-140K (with G10Z interaction chamber), HC-5000 (with L30Z or H230Z interaction chamber) and HC-8000 (with E230Z or L30Z interaction chamber), all of which manufactured by Microfluidex International Corporation.

Using these apparatuses, water-base dispersion containing at least organic silver salt is fed to a piping while being pressurized with a high-pressure pump or so, then the dispersion is passed through a narrow slit provided in the piping thereby to apply desired pressure, and then the pressure within the piping is quickly released to recover the atmospheric pressure thereby to cause an abrupt pressure drop of the dispersion. Thus can be obtained the organic silver salt dispersion optimum for the present invention.

In the present invention, it is possible to disperse the organic silver salt so as to attain a desired grain size by properly adjusting the flow rate, pressure difference at the time of the pressure drop and the number of repetition of the process. Taking photographic properties and the grain size into account, the flow rate is preferably from 200 to 600 m/sec, more preferably from 300 to 600 m/sec, and the pressure difference at the pressure drop is preferably from 900 to 3000 kg/cm$^2$, and more preferably from 1500 to 3000 kg/cm$^2$. The number of repetition of the process is selectable as required. While this is generally selected as once to as much as 10 times, once to as much as 3 times is preferred from the viewpoint of productivity. Raising the temperature of such water-base dispersion under high pressure is undesirable from the viewpoint of dispersibility and photographic properties, that is, raising the temperature above 90° C. tends to result in increased grain size and increased fogging. It is thus preferable in the present invention to provide a cooling step before the conversion into the high-pressure, high-speed flow and/or after the pressure drop, to maintain the temperature of the water-base dispersion within a range from 5 to 90° C., more preferably from 5 to 80° C., and still more preferably 5 to 65° C. Providing such cooling step is exceptionally effective when the dispersion is proceeded under the pressure as high as 1500 to 3000 kg/cm$^2$. A cooler is properly selected, depending on the required capacity of heat exchange, from these being equipped with a double pipe or double pipe as combined with a static mixer; shell-and-tube heat exchanger; and coiled heat exchanger. The diameter, wall thickness and material of the pipe are properly be selected, considering the operating pressure, so as to improve the efficiency of the heat exchange. Coolants available for the cooler include wall water at 20° C.; cold water at 5 to 10° C. fed from a chiller; and, as requested, ethylene glycol/water at −30° C.

In the dispersion process of the present invention, the organic silver salt is preferably dispersed under the pressure of a dispersant (dispersion aid) soluble to water-base solvents. The dispersant can be suitably selected from, for example, synthetic anionic polymers such as polyacrylic acid, copolymers of acrylic acid, maleic acid copolymers, maleic acid monoester copolymers and acryloylmethylpropanesulfonic acid copolymers; semisynthetic anonic polymers such as carboxymethylated starch and carboxymethylcellulose; anionic polymers such as alginic acid and pectic acid; compounds disclosed in JP-A-7-350753; known anionic, nonionic and cationic surfactants; other known polymers such as polyvinyl alcohol, polyvinylpyrrolidone, carboxymethyl cellulose, hydroxypropyl cellulose, and hydroxypropylmethyl cellulose; naturally occurring polymers such as gelatin and the like. Most preferable are polyvinyl alcohols and water-soluble cellulose derivatives.

The dispersant is generally mixed with the organic silver salt in a form of powder or wet cake before the dispersing operation, and fed as slurry into a dispersion apparatus, whereas the dispersant may also be included in the power or wet cake by heat treatment or solvent treatment of the dispersant premixed with the organic silver salt. The pH may be controlled with a suitable pH adjusting agent during or after the dispersing operation.

Besides such mechanical dispersing operation, the organic silver salt can preliminarily be dispersed into solvent by pH control, and then can thoroughly be dispersed by altering pH under the presence of the dispersant. The solvent for the preliminary dispersion may be organic solvent, which is generally removed after the thorough dispersion.

The produced dispersion can be stored under stirring in order to prevent precipitation of the microparticles during storage, or stored in a highly viscous state by producing hydrophilic colloid (e.g. jelly state formed with gelatin). Further, it may be added with a preservative in order to prevent germ proliferation during the storage.

In the present invention, the silver salt can be used in a desired amount, which is preferably 0.1 to 5 g as an amount of silver per 1 m$^2$ of the recording material, and more preferably 1 to 3 g/m$^2$.

The image-forming layer in the present invention may contain a plasticizer or lubricant, and examples thereof include polyhydric alcohols (for example, glycerin and diol described in U.S. Pat. No. 2,960,404); fatty acid or ester described in U.S. Pat. Nos. 2,588,765 and 3,121,060; and silicone resin described in British Patent No. 955,061.

The image recording material of the present invention may have a surface protective layer for preventing adhesion of the image-forming layer.

While any kind of polymer is available for a binder contained in the surface protective layer in the present invention, it is preferable that a polymer having carboxylic acid residues is used at an amount from 100 mg/m$^2$ to 5 g/m$^2$. The polymers having carboxylic acid residues described herein include natural polymers (e.g. gelatin, arginic acid); modified natural polymers (e.g. carboxymethylcellulose, phthalized gelatin); and synthetic polymers (e.g. polymethacrylate, polyacrylate, polyalkylmethacrylate/acrylate copolymer, polystyrene/polymethacrylate copolymer). Contents of the carboxylic acid residues in these polymers are preferably 10 nmol to 1.4 mol per 100 g of polymer. The carboxylic acid residues can form salts with, for example, alkali metal ion, alkali earth metal ion and organic cation.

Any kind of adhesion preventive material is available for the surface protective layer in the present invention. Examples of the adhesion preventive material include wax; silica particle; styrene-containing elastomeric block copolymer (e.g. styrene-butadiene-styrene, styrene-isoprene-styrene); cellulose acetate; cellulose acetate butylate; cellulose propionate; and mixtures thereof. The surface protective layer may also contain a crosslinking agent for crosslinking, and surfactant for improving coating property.

The image-forming layer and the protective layer thereof in the present invention may contain a light absorbing substance and filter dye as described in U.S. Pat. No. 3,253,921, No. 2,274,782, No. 2,527,583 and No. 2,956,879. It is also allowable to dye through mordanting as described, for example, in U.S. Pat. No. 3,282,699. The filter dye is preferably used in an amount so as to attain an absorbance of 0.1 to 3, and more preferably 0.2 to 1.5.

The photosensitive layer in the present invention may contain a dye or pigment of various types so as to improve the color tone or prevent the irradiation. Any dye or pigment may be used in the photosensitive image-forming layer, and examples thereof include pigments and dyes listed in the Color Index. Specific examples thereof include organic and inorganic pigments such as pyrazoloazole dye, anthraquinone dye, azo dye, azomethine dye, oxonol dye, carbocyanine dye, styryl dye, triphenylmethane dye, indoaniline dye, indophenol dye and phthalocyanine. Preferred examples of the dye for use in the present invention include anthraquinone dyes (e.g. Compounds 1 to 9 described in JP-A-5-341441, Compounds 3-6 to 3-18 and 3-23 to 3-38 described in JP-A-5-165147), azomethine dyes (e.g. Compounds 17 to 47 described in JP-A-5-341441), indoaniline dyes (e.g. Compounds 11 to 19 described in JP-A-5-289227, Compound 47 described in JP-A-5-341441, Compounds 2-10 and 2-11 described in JP-A-5-165147) and azo dye (Compounds 10 to 16 described in JP-A-5-341441). The dye may be added in any form of solution, emulsified product or solid microparticle dispersion or may be added in the state mordanted with a polymer mordant. The amount of such compounds used may be determined according to desired absorbance, and, in general, the compounds are preferably used in an amount of from $1\times10^{-6}$ to 1 g per 1 m$^2$ of the recording material.

The heat-developable photosensitive material of the present invention is preferably of a so-called single-sided type comprising a support having on one side thereof at least one photosensitive layer containing silver halide emulsion (preferably an image-forming layer) and on the other side thereof a back layer.

In the present invention, the back layer preferably has a maximum absorption in a desired wavelength region of from approx. 0.3 to 2.0. For the desired wavelength region of 750 to 1400 nm, the back layer is preferably an antihalation layer with an optical density within a wavelength region from 360 to 750 nm of 0.05 or larger and less than 0.5, and more preferably 0.001 or larger and less than 0.3. For the desired wavelength region of 750 nm or shorter, the back layer is preferably an antihalation layer with a maximum optical density within such desired wavelength region before image formation of 0.3 to 2.0, and with an optical density within a wavelength region from 360 to 750 nm after the image formation of 0.005 or larger and less than 0.3. While there is no limitation on the method for lowering the optical density into the above-described range after the image formation, possible methods include such that using heat-assisted fading of dye color described in Belgian Patent No. 733,706, and that decreasing the density by photoirradiation-assisted fading described in JP-A-54-17833.

In the case when an antihalation dye is used in the present invention, the dye may be any compound so long as the compound has a desired absorption in the desired wavelength region, the absorption in the visible wavelength region can sufficiently be reduced after the processing, and the back layer can have a preferred absorption spectrum form. While examples thereof include those described in the following patent publications, the present invention is by no means limited thereto: as a single dye, the compounds described in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is faded after the processing, the compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-B-50-16648, JP-B-2-41734 and U.S. Pat. No. 4,088,497, No. 4,283,487, No. 4,548,896 and No. 5,187,049.

The binder preferably applied to the back layer in the present invention is transparent or semi-transparent, colorless in general, and can be made of natural polymer, synthetic resin, polymer and copolymer, as well as other film-forming media such as gelatin, gum arabic, poly(vinyl alcohol), hydroxyethylcellulose, cellulose acetate, cellulose acetate butylate, poly(vinylpyrrolidone), casein, starch, poly (acrylic acid), poly(methyl methacylate), poly(vinyl chloride), poly(methacylic acid), copoly(styrene-maleic anhyride), copoly(styrene-acrylonitrile), copoly(styrene-butadiene), polyvinyl acetals (such as poly(vinylformal) and poly(vinylbutyral)), polyesters, polyurethanes, phenoxy resin, poly(vinylidene chloride), polyepoxides, polycarbonates, poly(vinyl acetate), cellulose esters and polyamides. The binder may also be formed by coating from water, organic solvent or emulsion.

For the single-sided heat-developable image recording material in the present invention, a matting agent may be added into the surface protective layer of the photosensitive emulsion layer and/or back layer, or into the surface protective layer for the back layer to improve the transport property. The matting agent appears, in general, as organic or inorganic fine particles insoluble to water. Arbitrary matting agents are available, examples of which include organic matting agents disclosed in U.S. Pat. No. 1,939,213, No. 2,701,245, No. 2,322,037, No. 3,262,782, No. 3,539,344 and No. 3,767,448; and inorganic matting agents disclosed in U.S. Pat. No. 1,260,772, No. 2,192,241, No. 3,257,206, No. 3,370,951, No. 3,523,022 and No. 3,769,020; all of which being well known in the related art. More specifically, the organic compounds available as the matting agent include water-dispersible vinyl polymers such as polymethyl acrylate, polymethyl methacrylate, polyacrylonitrile, acrylonitrile-α-methylstyrene copolymer, polystyrene, styrene-divinylbenzene copolymer, polyvinyl acetate, polyethylene carbonate and polytetrafluoroethylene; cellulose derivatives such as methylcellulose, cellulose acetate, and cellulose acetate propionate; starch derivatives such as carboxystarch, carboxynitrophenylstarch, and urea-formaldehyde-starch reaction product; gelatin hardened with a known hardening agent; and hardened gelatin in form of fine capsulated hollow particle obtained by coacervate hardening. Preferable examples of the inorganic compounds include silicon dioxide, titanium dioxide, magnesium dioxide, aluminum oxide, barium sulfate, calcium carbonate, silver chloride desensitized by a known method, silver bromide similarly processed, glass and diatom earth. Different kinds of the matting agent may be combined for use as required. There are no special limitation on the size and morphology of the matting agent, and that having an arbitrary diameter is available. For implementing the present invention, it is preferable to use a matting agent with 0.1 to 30 μm diameter. Both of wide and narrow particle size distributions of the matting agent are allowable. Since the matting agent strongly affects the haze and surface gloss of the photosensitive material, the particle size, morphology and particle size distribution of which are preferably selected as required at the time of preparation of the matting agent, or sometimes by mixing two or more matting agents.

A preferable embodiment of the present invention relates to adding the matting agent to the back layer, where the degree of matting of the back layer is preferably expressed as a Bekk smoothness of 10 to 1200 seconds, and more preferably 50 to 700 seconds.

In the present invention, the matting agent is preferably added to an outermost layer or a layer functions as the outermost layer of the recording material, or to a layer provided near the outer surface thereof, and in particular to a layer functions as a so-called protective layer. While there is no special limitation on the degree of matting so long as stardust failure does not occur, the Bekk smoothness falls preferably within a range from 500 to 10,000 seconds, and more preferably 500 to 2,000 seconds.

The heat-developable photographic emulsion in the present invention forms on the support one or more layers. In the monolayer composition, the layer must contain organic silver salt, photosensitive silver halide, reducing agent and binder, and may additionally contain color toner, coating aid and other auxiliary agents as required. In the double-layer composition, a first emulsion layer (usually adjacent to the substrate) must contain an organic silver salt and a silver halide, and a second layer or both layer must contain some other components. Alternative double-layer composition may be allowable in which a single emulsion layer contains all components and a protective topcoat is provided thereon. A multicolor photosensitive heat-developable photographic material may have a structure such that a combination of the above-described two layers is provided for the respective colors, or, as described in U.S. Pat. No. 4,708,928, a structure such that a single layer contains all components. In the case of a multi-dye multicolor photosensitive heat-developable photographic material, the respective emulsion layers are generally kept away from each other by using a functional or non-functional barrier layer between the respective emulsion layers (photosensitive layers) as described in U.S. Pat. No. 4,460,681.

A backside resistive heating layer described in U.S. Pat. Nos. 4,460,681 and 4,374,921 may also be used in the heat-developable photosensitive photographic imaging system of the present invention.

In the present invention, layers such as the image-forming layer (preferably a photosensitive layer), protective layer and back layer each may contain a hardening agent. Examples of the hardening agent include polyisocynates described in U.S. Pat. No. 4,281,060 and JP-A6-208193; epoxy compounds described, for example, in U.S. Pat. No. 4,791,042; and vinyl sulfone-based compounds described, for example, in JP-A-62-89048.

Surfactants may preferably used in the present invention to improve the coating property and electric charging. Nonionic, anionic, cationic, fluorine-containing, and any other types of surfactants are properly available. More specifically, they are exemplified as fluorine-containing polymer surfactants disclosed, for example, in JP-A-62-170950 and U.S. Pat. No. 5,380,644; fluorine-containing surfactants disclosed, for example, in JP-A-60-244945 and JP-A-63-188135; polysiloxane-base surfactants disclosed, for example, in U.S. Pat. No. 3,885,965; polyalkylene oxide disclosed, for example, in JP-A-6-301140; and anionic surfactants.

The heat-developable photographic emulsion in the present invention may generally be coated on a variety of supports. Typical supports include polyester film, undercoat polyester film, poly(ethylene terephthalate) film, poly (ethylene naphthalate) film, cellulose nitrate film, cellulose ester film, poly(vinyl acetal) film, polycarbonate film and related resin material, glass, paper and metal. Typically used are flexible materials such as baryta and/or partially acetylated paper support, and in particular paper support coated with α-olefin polymer; α-olefin polymer being such that having a carbon number of 2 to 10, such as polyethylene, polypropylene and ethylene-butene copolymer. Both of transparent and opaque supports are allowable, the former being more preferable. Among these, exceptionally preferable is polyethylene terephthalate (PET) film of approx. 75 to 200 μm thick processed by biaxial stretching.

In general, plastic film will alter its dimension when passed through a heat developing apparatus for processes at 80° C. or above. Such dimensional change will raise a critical problem in precision multicolor printing when the processed film is used for printing plate making. It is therefore preferable in the present invention to use a film with less dimensional change devised so that the residual internal distortion in the film is relieved during the biaxial stretching to prevent distortion by heat shrinking during the heat development. Preferably used is a polyethylene terephthalate film preliminarily subjected to heat treatment at 100 to 210° C. before the heat-developable photographic emulsion is coated thereon. Materials with high glass transition temperatures are also preferably used, and such materials include polyether ethyl ketone, polystyrene, polysulfone, polyethersulfone, polyarylate and polycarbonate.

The heat-developable photosensitive material of the present invention may have, for an antistatic purpose, a layer containing or comprising soluble salts (e.g. chloride, nitrate); vapor-deposited metal; ionic polymers disclosed in U.S. Pat. Nos. 2,861,056 and 3,206,312; insoluble inorganic salts disclosed in U.S. Pat. No. 3,428,451; and stannic oxide, fine particles disclosed in JP-A-60-252349 and JP-A-57-104931.

A method for obtaining a color image using the heat-developable image recording material of the present invention is described in JP-A-7-13295, from line 43 on page 10 in the left column to line 40 on page 11 in the left column. Stabilizing agents for color dye image are described in British Patent No. 1,326,889, U.S. Pat. No. 3,432,300, No. 3,698,909, No. 3,574,627, No. 3,573,050, No. 3,764,337 and No. 4,042,394.

The heat-developable photographic emulsion in the present invention may be coated by a variety of coating processes, which include dip coating, air knife coating, flow coating, and extrusion coating using a specific hopper described in U.S. Pat. No. 2,681,294. It is also allowable to simultaneously coat two or more layers as required according to the methods described in U.S. Pat. No. 2,761,791 and British Patent No. 837,095.

The heat-developable image recording material of the present invention may have additional layers such as dye accepting layer for accepting mobile dye image, opaque layer for effectuating reflective printing, protective top coat layer, and primer layer already known in the field of photothermal printing technology. It is preferable that the heat-developable image recording material of the present invention is capable of producing image solely by itself. That is, it is preferable that the functional layer necessary for forming image, such as image accepting layer, is not provided on the separate material.

The sensitizing dye used in the present invention may arbitrarily be selected from those capable of spectrally sensitizing the silver halide particles at a desired wavelength region by adhering thereon. As such sensitizing dyes, usable are, for example, cyanine dyes, merocyanine dyes, complex cyanine dyes, complex merocyanine dyes, holopolar cyanine dyes, styryl dyes, hemicyanine dyes, oxonole dyes and hemioxonole dyes. Sensitizing dyes which are usable in the present invention are described, for example, in *Research Disclosure,* Item 17643, IV-A (December, 1978, page 23), ibid. Item 1831X (August, 1978, page 437) and also in the references as cited therein. In particular, sensitizing dyes having a spectral sensitivity suitable for spectral characteristics of light sources of various laser imagers, scanners, image setters, process cameras and the like can advantageously be selected.

Exemplary dyes advantageous for the spectral sensitization to red light from so-called red light sources such as He-Ne laser, red semiconductor laser and red LED, include Compounds I-1 to I-38 disclosed in JP-A-54-18726; Compounds I-1 to I-35 disclosed in JP-A-6-75322; Compounds I-1 to I-34 disclosed in JP-A-7-287338; Dyes 1 to 20 disclosed in JP-B-55-36818; Compounds I-1 to I-37 disclosed in JP-A-62-284343; and Compounds I-1 to I-34 disclosed in JP-A-7-287338.

Spectral sensitization as to the wavelength region of from 750 to 1,400 nm from semiconductor laser light sources can advantageously be obtained with various known dyes such as cyanine dye, merocyanine dye, styryl dye, hemicyanine dye, oxonol dye, hemioxonol dye and xanthene dye. Useful cyanine dyes are those having a basic nucleus such as thiazoline nucleus, oxazoline nucleus, pyrroline nucleus, pyridine nucleus, oxazole nucleus, thiazole nucleus, selenazole nucleus or imidazole nucleus. Useful merocyanine dyes are those having the above-described basic nucleus or an acidic nucleus such as thiohydantoin nucleus, rhodanin nucleus, oxazolidinedione nucleus, thiazolinedion nucleus, barbituric acid nucleus, thiazolinone nucleus, malononitrile nucleus or pyrazolone nucleus. Of these cyanine and merocyanine dyes, those having an imino group or a carboxyl group are particularly effective. The dye may be appropriately selected from known dyes described, for example, in U.S. Pat. No. 3,761,279, No. 3,719,495 and No. 3,877,943, British Patents No. 1,466,201, No. 1,469,177 and No. 1,422,057, JP-B-3-10391 and JP-B-6-52387, JP-A-5-194781 and JP-A-6-301141.

The dyes particularly preferably used for the present invention include cyanine dyes having a thioether bond (e.g. those described in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-1-6-324425, JP-W-A-7-500926 (the code "JP-W-A" as used herein means an "international application published in Japanese for Japanese national phase"), and U.S. Pat. No. 5,541,054); dyes having a carboxylic acid group (e.g. dyes disclosed in JP-A-3-163440, JP-A-6-301141, and U.S. Pat. No. 5,441,899); merocyanine dyes; polynuclear merocyanine dyes; and polynuclear cyanine dyes (those disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-W-A-55-50111, British Patent No. 1,467,6438, and U.S. Pat. No. 5,281,515) and the like.

Dyes forming J-band have been disclosed in U.S. Pat. Nos. 5,510,236 and 3,871,887 (Example 5), JP-A-2-96131 and JP-A-59-48753, and the like, and they can preferably be used for the present invention.

These sensitizing dyes may be used either individually or in combination of two or more thereof. The combination of sensitivity dyes is often used for the purpose of supersensitization. In combination with the sensitizing dye, a dye which itself has no spectral sensitization effect, or a material which absorbs substantially no visible light but exhibits supersensitization maybe incorporated into the emulsion. Useful sensitizing dyes, combinations of dyes which exhibit supersensitization, and materials which show supersensitization are described in *Research Disclosure,* Vol. 176, 17643, page 23, Item IV–J (December, 1978), JP-B-49-25500 and JP-B-43-4933, JP-A-59-19032 and JP-A-59-192242, and the like.

The sensitizing dye may be added to the silver halide emulsion by dispersing it directly in the emulsion or may be added to the emulsion after dissolving it in a solvent such as water, methanol, ethanol, propanol, acetone, Methyl Cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide; these solvents being used solely or by mixing.

Furthermore, the sensitizing dye may be added using a method disclosed in U.S. Pat. No. 3,469,987 by which the dye is dissolved in a volatile organic solvent, the obtained solution is then dispersed in water or hydrophilic colloid, and the obtained dispersion is added to the emulsion; methods disclosed in JP-B-44-23389, JP-B-44-27555 and JP-B-57-22091 by which the dye is dissolved in an acid, and then the obtained solution is added to the emulsion as it were or in the form of aqueous solution under the presence of acid or base; methods disclosed in U.S. Pat. Nos. 3,822,135 and 4,006,025 by which the dye, under the presence of surfactant, in a form of aqueous solution or colloid dispersion is added to the emulsion; methods disclosed in JP-A-53-102733 and JP-A-58-105141 by which the dye is dispersed directly in hydrophilic colloid and the obtained dispersion is added to the emulsion; or a method disclosed in JP-A-51-74624 by which the dye is dissolved using a compound capable of red shifting and the obtained solution is added to the emulsion. An ultrasonic wave may also be used in dissolving the dye.

In the preparation of the emulsion, the sensitizing dye may be added in any process steps as far as efficiency of which ever authorized. For example, in the grain formation process of silver halide and/or before desalting, or during the desalting process and/or the time period from desalting up to the initiation of chemical ripening, as disclosed in U.S. Pat. No. 2,735,766, No. 3,628,960, No. 4,183,756 and No. 4,225,666, JP-A-58-184142 and JP-A-60-196749, or immediately before or during the chemical ripening process, or in the time period after chemical ripening up to coating, as disclosed in JP-A-58-113920. Furthermore, as disclosed in U.S. Pat. Nos. 4,225,666 and JP-A-58-7629, a single kind of compound per se may be added in parts or the compound in combination with another compound having a different structure may be added in parts, for example, one part is added during grain formation and another part is added during or after the chemical ripening; or one part is added before or during the chemical ripening and another part is added after completion of the chemical ripening. When the compound is added in parts, the compound or combination of the compound added in parts may be altered for each addition process.

The amount of the sensitizing dye used in the present invention maybe selected according to the performance such as sensitivity or fog; where it is preferably from $10^{-6}$ to 1 mol per one mol of silver halide in the photosensitive layer, and more preferably from $10^{-4}$ to $10^{-1}$ mol.

In the present invention, a contrast accelerating may be used in combination with the above-described ultrahigh contrast agent so as to produce an ultrahigh contrast image. Examples thereof include amine compounds described in U.S. Pat. No. 5,545,505, specifically, AM-1 to AM-5, hydroxamic acids described in U.S. Pat. No. 5,545,507, specifically, HA-1 to HA-11; acrylonitriles described in U.S. Pat. No. 5,545,507, specifically, CN-1 to CN-13; hydrazine compounds described in U.S. Pat. No. 5,558,983, specifically, CA-1 to CA-6; and onium salts described in JP-A-8-132836, specifically, A-1 to A-42, B-1 to B-27 and C-1 to C-14.

In the present invention, an exposure apparatus used for the image-wise exposure may be of any type provided that it affords an exposure period of not longer than $10^{-7}$ seconds, and is preferably in general such apparatus having a light source such as a laser diode (LD) or light emitting diode (LED). LD is more preferable in terms of high output and excellent resolution. These light sources may be of any type provided that they can emit light within an electromagnetic spectral range of desired wavelengths. Available LDs include, for example, a dye laser, gas laser, solid laser and semiconductor laser.

In the present invention, the exposure is effected so that the beam loca are partially overlapped. The overlap means that the subscanning pitch width is smaller than the beam spot diameter. When the beam spot diameter is expressed by, for example, a half width of the beam intensity, the overlap can quantitatively be expressed by FWHM/subscanning pitch width (an overlap coefficient). The overlap coefficient is preferably 0.2 or larger in the present invention.

There is no special limitation on the scanning system of the light source of the exposure apparatus employed in the present invention, and available systems include outer cylinder surface scanning system, inner cylinder surface scanning system and planar scanning system. Both of single channel and multi-channel systems are available for the light source, where the multi-channel system is preferable for the outer cylinder surface scanning system.

The heat-developable recording material of the present invention has a low haze at the time of exposure and is liable to incur generation of interference fringes. For preventing the generation of interference fringes, a technique of entering a laser light obliquely with respect to the recording material disclosed in JP-A-9-113548 and a method of using a multimode laser disclosed in International Patent Publication WO95/31754 are known and these techniques are preferably used.

The heat-developable photosensitive material of the present invention may be developed by any method, while in general the development is performed by elevating the temperature of the recording material after the image-wise exposure. Preferred embodiments of the heat-developing apparatus used include: those making the heat-developable image recording material into contact with a heat source such as a heat roller or heat drum as disclosed in JP-B-5-56499, Japanese Patent No. 684453, JP-A-9-292695, JP-A-9-297385 and International Patent Publication WO95/30934; and those of non-contacting type as disclosed in JP-A-7-13294, International Patent Publications WO97/28489, WO97/29488 and WO97/28487. Of these, the non-contacting type heat-developing apparatus is preferred. The development temperature is preferably from 80 to 250° C., more preferably from 100 to 140° C. The development time is preferably from 1 to 180 seconds, more preferably from 10 to 90 seconds.

For preventing uneven processing due to dimensional changes in the heat-developable image recording material of the present invention during heat development, it is preferable to heat the material at a temperature of 80° C. or above and less than 115° C. for 5 seconds or more so as to prevent the image from appearing, and then develop the material by heating at a temperature of 110 to 140° C. to produce the image (so-called multi-stage heating method).

The present invention will be explained in more detail with reference to the following examples.

EXAMPLES

Example 1

The following layers were formed on a PET base of 100 μm thick: (Forming the back layer by coating)

| First Black Layer | |
|---|---|
| JURIMER ET-410 (Nippon Jun'yaku KK) | 38 mg/m$^2$ |
| $SnO_2$/Sb (9/1 by weight, acicular microparticle, product of Ishihara Sangyo Kaisha, Ltd., product name FS-10D) | 200 mg/m$^2$ |
| Dye A | 20 mg/m$^2$ |
| Matting agent (polymethylmethacrylate microparticle, Average particle size 5 μm | 10 mg/m$^2$ |
| Crosslinking agent (DENACOL EX-614B, product of Nagase Chemicals Ltd.) | 13 mg/m$^2$ |
| **Second Black Layer** | |
| Latex binder (CHEMIPEARL S-120, product of Mitsui Chemical Co., Ltd.) | 500 mg/m$^2$ |
| Colloidal silica (SNOWTEX-C, product of Nissan Chemical Industries, Ltd.) | 40 mg/m$^2$ |
| Crosslinking agent (DENACOL EX-614B, product of Nagase Chemicals Ltd.) | 30 mg/m$^2$ |

Both back layers were formed by sequential coating and dried at 180° C. for 4 minutes.

(Annealing of Support)

After the back layer is formed by coating and dried, a first annealing was performed under a tension of 5 kg/cm$^2$ at 130° C. for 10 minutes, which was followed by a second annealing under a tension of 10 kg/cm$^2$ at 40° C. for 15 seconds.

(Preparation of Silver Halide Grain)

To 700 ml of water, 11 g of phthalized gelatin, 30 mg of potassium bromide and 10 ng of sodium thiosulfonate were added, and after conditioned at pH5.0 and 35° C., 159 ml of an aqueous solution containing 18.6 g of silver nitrate and an aqueous solution containing 1 mol/l of potassium bromide were added by the controlled double jet method over 6.5 minutes while keeping the pAg at 7.7. Subsequently, 476 ml of an aqueous solution containing 55.4 g of silver nitrate and an aqueous solution containing 1 mol/l of potassium bromide were added by the controlled double jet method over 30 minutes while keeping the pAg at 7.7. Thereafter, 1 g of 4-hydroxy-6-methyl-1,3,3*a*,7-tetrazaindene was added to the mixture, and the pH of which was lowered to cause coagulation precipitation to thereby effect desalting. Then 0.1 g of phenoxyethanol was added, conditioned at pH5.9 and pAg8.2, to obtain silver bromide grain (cubic grain having an average grain size of 0.12 μm, a coefficient of variation of the projected area of 8% and a (100) plane ratio of 88%).

Thus obtained silver halide was heated to 60° C., added with $8.5\times10^{-4}$ mol/mol Ag of sodium thiosulfonate, ripened for 120 minutes, rapidly cooled to 40° C., added with $1\times10^{-5}$ mol of Coloring matter S-1, $5\times10^{-5}$ mol of Compound B and $5\times10^{-4}$ mol of N-methyl-N'-{3-(mercaptotetrazolyl)phenyl} urea, and rapidly cooled to 30° C., to obtain a silver halide emulsion.

Coloring matter S-1

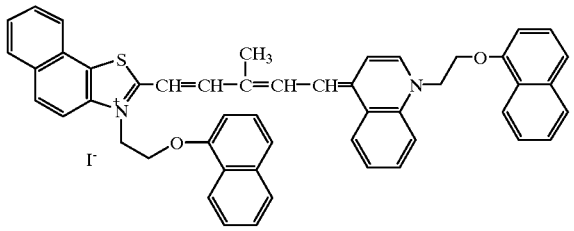

Compound B

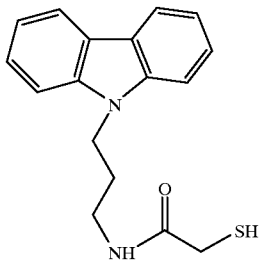

(Preparation of Organic Acid Silver Dispersion)

A mixture of 4.4 g of stearic acid, 39.4 g of behenic acid and 770 ml of distilled water was added with 103 ml of an aqueous 1N NaOH solution under stirring at 90° C., allowed to react for 240 minutes, and cooled to 75° C. Subsequently, the mixture was added with 112.5 ml of the aqueous solution containing 19.2 g of silver nitrate was added over 45 seconds, allowed to stand for 20 minutes, and then cooled to 30° C. Thereafter, the solid-content was separated by suction filtration, and washed with water until the conductivity of the filtrate became 30 μS/cm. Thus obtained solid content was added with 100 ml of a 10 wt % aqueous polyvinylalcohol solution, and further added with water to adjust the total weight of 270 g. The resulting mixture was preliminarily dispersed using an automatic mortar, and then thoroughly dispersed using a dispersion apparatus "Nanomizer" (trade name, product of Nanomizer, Ltd.) under a collision pressure of 1000 kg/cm$^2$. The resultant dispersion is added with water to adjust the concentration thereby to obtain an organic acid silver dispersion containing 0.3 mol of silver per 1 kg of the dispersion. The dispersoid was an acicular particle with an average short axis length of 0.04 μm, an average long axis length of 0.8 μm and a coefficient of variation of 30%.

(Preparation of Reductive Compound Dispersion)

One hundred grams of 1,1-bis(2-hydroxy-3,5-dimethylphenyl)-3,5,5-trimethylhexane and 50 g of polyvinylalcohol were added with 850 g of water, and then mixed thoroughly to prepare a slurry. The slurry was then put into a vessel of a sandmill (¼G Sand Grinder Mill, product of Aimex, Ltd.) together with 840 g of dispersion beads (zirconia grain with an average diameter of 0.5 mm), and was dispsersed for 5 hours to obtain a reductive compound agent dispersion with an average particle size of 0.5 μm.

(Preparation of Antifoggant Dispersion)

Fifty grams of tribromomethylsulfonylquinoline and 10 g of Kuraray Poval MP-203 (product of Kuraray Co., Ltd.) were added with 940 g of water, and were then thoroughly mixed to prepare a slurry. The slurry was dispersed using zirconia beads as described above in relation to the reducing agent, the obtain a dispersion with an average particle size of 0.4 μm.

(Preparation of Ultrahigh Contrast Agent Dispersion)

Ten grams of the ultrahigh contrast spent (No. 62) described elsewhere in this specification and 2.5 g of Kuraray Poval #217 (product of Kuraray Co., Ltd.) were added with 87.5 g of water, and were then dispersed using zirconia heads as described above in relation to the reducing agent, to obtain a dispersion with an average particle size of 0.3 μm.

(Preparation of Salicylic Acid Derivative Dispersion)

Ten grams of silicylic acid shown below and 2 q of Kuraray Poval were added with 88 g of water, and were then dispersed using zirconia beads as described above in relation to the reducing agent, to obtain a dispersion with an average particle size of 0.4 μm.

Salicylic acid derivative

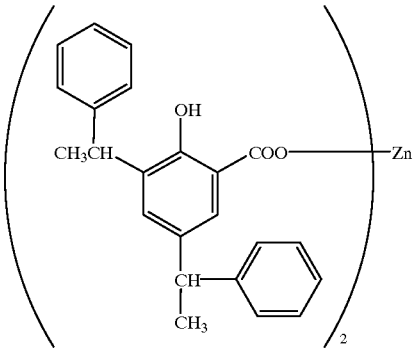

<Preparation of Sample 101 (Comparative Sample)>

(Preparation and Coating of Photosensitive Layer Coating Liquid)

One hundred grams of the above organic acid silver dispersion, 20 g of the reductive compound dispersion, 12 g of the antifoggant dispersion, 40 g of LACSTAR #3307B (SBR latex, product of Dai-Nippon Ink & Chemicals, Inc., Tg=13° C., 49 wt %), 40 g of 10 wt % Kuraray Poval MP-203, 20 g of the silver halide emulsion, 2 g of the ultrahigh contrast agent dispersion, 0.01 g of 5-methylbenzotriazole, 2 mg of sodium dihydrogen phosphate, 1.4 g of the dispersion of the above salicylic acid derivative and 6 mg of Dye A shown below were added with 100 g of water, and then thoroughly mixed. The obtained coating liquid was coated on the support on the side opposite to that the back layer is formed so that the amount of coated silver reaches 1.5 g/m$^2$.

Dye A

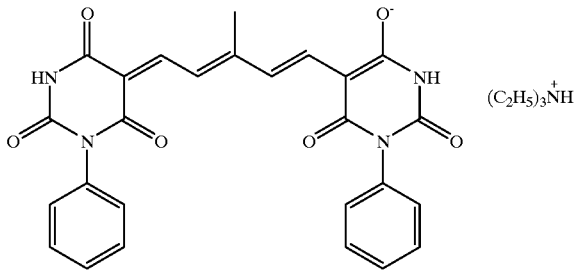

(Preparation and Coating of Protective Layer Coating Liquid)

Five hundred grams of 40 wt % polymer latex (copolymer of methylmethacrylate/styrene/2-ethylhexylacrylate/2-hydroxyethyl methacrylate/metacrylic acid, copolymerization ratio=59/9/26/5/1, Tg=47° C.) was added with 262 g of water, to which further sequentially added were 14 g of Compound-D as a filming aid, 2.5 g of Compound-2 shown below, 3.6 g of CELLOSOL 524 (product of Chukyo Oil and Fat, Ltd.), 12 g of Compound-3 shown below, 1 g of Compound-4 shown below, 2 g of Compound-5 shown below, 7.5 g of Compound-6 shown below and 3.4 g of polymethylmethacrylate particle with an average particle size of 3 μm as a matting agent, further added with water to total 1000 g, to prepare a coating liquid with a viscosity of 5 cp (at 25° C.), ph3.4. Thus obtained coating liquid was coated so that the amount of solid content of the polymer latex reaches 2 g/m$^2$.

Compound-2

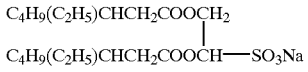

Compound-3

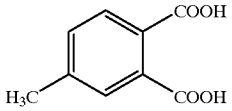

Compound-4

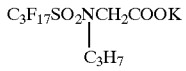

Compound-5

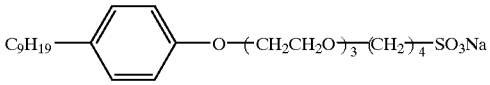

Compound-6

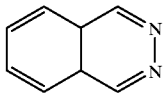

Compound-D

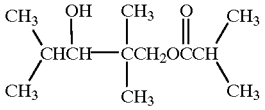

The photosensitive layer and protective layer were simultaneously formed by coating in a stacked manner, and were dried at 60° C. for 2 minutes after the coating.

<Preparation of Sample 102 of the Present Invention, and Comparative Samples 103, 104>

Sample 102 was prepared by adding, to Sample 101, sulfonamidophenol compound (D-1) as an auxiliary reductive compound in an amount of 2 mol % of 1,1-bis(2-hydroxy-3,5-dimethylphenyl)-3,5,5-trimethylhexane (R-1) as a main reduction compound. For comparison, Comparative Sample 103, not containing 1,1-bis(2-hydroxy-3,5-dimethylphenyl)-3,5,5-trimethylhexane, was prepared by adding only sulfonamidophenol compound (D-1) at 2 mol %.

Comparative Sample 104 was prepared by adding Compound-P as an auxiliary reductive compound shown below in an amount of 2 mol % of 1,1-bis(2-hydroxy-3,5-dimethylphenyl)-3,5,5-trimethylhexane as a main reductive compound. Compound-P is an undesirable example of the auxiliary reductive compound.

Compound-P

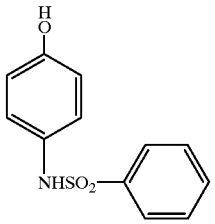

(Evaluation of Development Progress Characteristics)

These Samples were exposed with a semiconductor laser sensitometer at 785 nm, then subjected to heat development at 118° C. for 5 to 30 seconds with an increment of 5 seconds, and a maximum density (Dmax) of the obtained image was measured with a densitometer to evaluate the development progress. Results were shown in Table 8. Comparative Sample 101 showed an induction period and the development was actualized 15 seconds after the commencement, whereas Sample of the present invention showed only a short induction period and the development was actualized as early as 5 to 10 seconds after. As judged from the result of Comparative Example 103 achieved only a slight development, the combined use of two reductive compounds was found to exhibit superadditivity. Comparative Example 104 showed a rapid development in the early stage, but an abrupt increase in the density occurred not so early and Dmax reached a plateau only at a low level.

(Evaluation of Development Uniformity)

Over the entire surface of the A2-size (594 mm×420 mm) film, dots were uniformly exposed with an area ratio of 50% using a dot generator, and then heat-developed at 118° C. for 25 seconds. Uniformly in the image density was visually evaluated.

Sample 102 was found to be excellent in the uniformity as compared with Comparative Examples.

Example 2

The search for combinations exhibiting superadditivity besides that described in Example 1 revealed that the following combinations can afford the equivalent effects. Table 9 shows Dmax values obtained after the development at 118° C. for 10 seconds. Larger value indicates faster development.

TABLE 9

| Sample No. | Main Reductive Compound | Auxiliary Reductive Compound | Dmax Value after 10-Sec Development |
|---|---|---|---|
| 201 | R-I-29 | D-1 | 1.27 |
| 202 | R-I-29 | D-2 | 1.55 |
| 203 | R-I-29 | D-3 | 1.15 |
| 204 | R-I-29 | D-4 | 1.20 |
| 205 | R-I-1 | D-2 | 1.08 |

What is claimed is:

1. A heat-developable image recording material containing an organic silver salt, a reducing agent, photosensitive silver halide grains and an organic binder characterized in that the reducing agent comprises a combination of two or more different reductive compounds exhibiting superadditivity.

2. The heat-developable image recording material as claimed in claim 1, wherein one of the superadditive reductive compounds constituting the combination is a hindered phenol compound and the other is a substituted sulfonamidophenol compound.

3. The heat-developable image recording material as claimed in claim 2, wherein the hindered phenol compound is contained within a range from $1\times10^{-2}$ to 10 mol per one mol of silver, and the sulfonamidophenol compound in a range from $1\times10^{-4}$ to $1\times10^{-1}$ mol per one mol of silver.

4. The heat-developable image recording material as claimed in claim 1, wherein a ratio of the substituted sulfonamidophenol compound to the hindered phenol compound is within a range from 0.1 to 50 mol %.

5. The heat-developable image recording material as claimed in claim 4, wherein a ratio of the substituted

TABLE 8

| Sample No. | Main Reductive Compound | Auxiliary Reductive Compound | Dmax value (Development time) | | | | | |
|---|---|---|---|---|---|---|---|---|
| | | | 5 sec | 10 sec | 15 sec | 20 sec | 25 sec | 30 sec |
| 101 (Comparative) | R-1* | — | 0.09 | 0.10 | 0.24 | 2.91 | 3.95 | 4.05 |
| 102 (Invention) | R-1* | D-1 | 0.35 | 1.78 | 3.15 | 4.10 | 4.10 | 4.20 |
| 103 (Comparative) | — | D-1 | 0.28 | 0.49 | 0.55 | 0.55 | 0.61 | 0.63 |
| 104 (Comparative) | R-1* | Compound-P | 0.22 | 0.35 | 0.64 | 2.38 | 2.63 | 2.75 |

*R-1: 1,1-bis(2-hydroxy-3,5-dimethylphenyl)-3,5,5-trimethylhexane sulfonamidophenol compound to the hindered phenol compound is within a range from 0.5 to 20 mol %.

6. The heat-developable image recording material as claimed in claim 1, wherein one of the superadditive reductive compound is a substituted sulfonamidophenol compound represented by the following formula (1):

Formula (1)

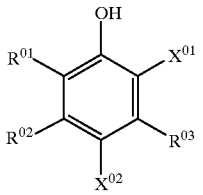

in the above formula, $X^{01}$ and $X^{02}$ independently represent a hydrogen atom; halogen atom, or substituent which is bound to the benzene ring via a carbon atom, oxygen atom, nitrogen atom, or sulfur atom; at least either of which being a sulfonamido group; $R^{01}$, $R^{02}$ and $R^{03}$ independently represent a hydrogen atom; halogen atom, or substituent which is bound to the benzene ring via a carbon atom, oxygen atom, nitrogen atom, or sulfur atom; wherein at least one substituent selected from the group consisting of $X^{01}$, $X^{02}$, $R^{01}$, $R^{02}$ and $R^{03}$ may be taken together with an adjacent of said at least one substituent or together with a benzene ring to form a cyclic structure.

7. The heat-developable image recording material as claimed in claim 6, wherein $R^{01}$ is not a hydrogen atom.

8. The heat-developable image recording material as claimed in claim 6, wherein the substituted sulfonamidophenol compound is represented by the following formula (3):

Formula (3)

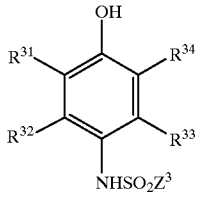

in the above formula, $R^{31}$ to $R^{34}$ independently represent a hydrogen atom; halogen atom, or substituent which is bound to the benzene ring via a carbon atom, oxygen atom, nitrogen atom, or sulfur atom; these substituents may be taken together with the adjacent ones or with a benzene ring to form a cyclic structure; and $Z^3$ represents an aliphatic, aromatic or heterocyclic group.

9. The heat-developable image recording material as claimed in claim 1, wherein an ultrahigh contrast agent is contained.

10. A heat-developable image recording material containing an organic silver salt, a reducing agent, photosensitive silver halide grains and an organic binder wherein the reducing agent comprises a combination of two or more different reductive compounds exhibiting development speed superadditivity.

* * * * *